US011149466B2

(12) United States Patent
Hernandez

(10) Patent No.: US 11,149,466 B2
(45) Date of Patent: Oct. 19, 2021

(54) PADLOCK WITH KEY-RETAINING COVER

(71) Applicant: Brady Worldwide, Inc., Milwaukee, WI (US)

(72) Inventor: Ignacio Mendez Hernandez, El Paso, TX (US)

(73) Assignee: Brady Worldwide, Inc., Milwaukee, WI (US)

( * ) Notice: Subject to any disclaimer, the term of this patent is extended or adjusted under 35 U.S.C. 154(b) by 302 days.

(21) Appl. No.: 16/269,214

(22) Filed: Feb. 6, 2019

(65) Prior Publication Data

US 2020/0248474 A1 Aug. 6, 2020

(51) Int. Cl.

| | |
|---|---|
| ***E05B 11/00*** | (2006.01) |
| ***E05B 67/02*** | (2006.01) |
| ***E05B 27/08*** | (2006.01) |
| ***E05B 67/38*** | (2006.01) |
| ***E05B 17/14*** | (2006.01) |

(52) U.S. Cl.

CPC ..... *E05B 11/00* (2013.01); *E05B 17/142* (2013.01); *E05B 27/083* (2013.01); *E05B 67/02* (2013.01); *E05B 67/38* (2013.01)

(58) Field of Classification Search

CPC ..... E05B 11/00; E05B 17/002; E05B 17/14; E05B 17/142; E05B 17/18; E05B 17/181; E05B 17/188; E05B 27/083; E05B 35/007; E05B 63/003; E05B 63/22; E05B 27/0003; E05B 27/0017; E05B 27/0046; E05B 27/02; E05B 27/08; E05B 29/00; E05B 29/0026; E05B 29/0053; E05B 2063/0026; E05B 67/00; E05B 67/02; E05B 67/06; E05B 67/22; E05B 67/24; E05B 67/38

See application file for complete search history.

(56) References Cited

U.S. PATENT DOCUMENTS 1,643,904 A * 9/1927 Rife ..... E05B 11/00 70/430
2,036,738 A 4/1936 Zygmunt
2,261,472 A * 11/1941 Hurd ..... E05B 17/188 70/455

(Continued)

FOREIGN PATENT DOCUMENTS

DE 29821634 U2 1/1999
FR 1147185 11/1957

OTHER PUBLICATIONS

European Patent Office, Extended European Search Report for application 20152447.7. dated May 14, 2020.

*Primary Examiner* — Christopher J Boswell

(74) *Attorney, Agent, or Firm* — Quarles & Brady LLP

(57) ABSTRACT

A padlock configured to be locked and unlocked by a key includes a key-retaining cover. The padlock includes a lock body having an internal cavity with a locking mechanism received therein. The locking mechanism is a linear lock configured to receive the key through a keyhole to lock and unlock the padlock. A direction of insertion of the key into the locking mechanism is parallel with a direction of displacement of a plurality of tumblers in the locking mechanism thereby creating an outward ejection force on a fully-inserted key. The cover is disposed on the locking mechanism proximate the keyhole. The cover is configured to retain the key in position relative to the locking mechanism against the outward ejection force after the key is received in therein.

19 Claims, 19 Drawing Sheets

(56) References Cited

U.S. PATENT DOCUMENTS

| | | | | | |
|---|---|---|---|---|---|
| 2,391,834 | A | | 12/1945 | Johnstone | |
| 2,395,762 | A | * | 2/1946 | Rober | E05B 17/002 70/35 |
| 2,469,018 | A | * | 5/1949 | Swanson | E05B 11/00 70/389 |
| 3,263,463 | A | * | 8/1966 | Duval | E05B 17/186 70/455 |
| 3,754,423 | A | * | 8/1973 | Seidewand | E05B 17/188 70/455 |
| 4,638,652 | A | * | 1/1987 | Morse | B60R 25/2063 70/454 |
| 4,671,090 | A | * | 6/1987 | Masaki | E05B 17/181 70/423 |
| 4,790,163 | A | * | 12/1988 | Appelbaum | E05B 17/188 70/455 |
| 5,934,121 | A | * | 8/1999 | Chen | E05B 21/066 70/365 |
| 6,397,647 | B1 | * | 6/2002 | Kuo | E05B 17/185 70/423 |
| 6,539,754 | B1 | * | 4/2003 | Fang | E05B 17/14 70/417 |
| 7,278,283 | B2 | | 10/2007 | Meckbach | |
| 7,581,423 | B2 | * | 9/2009 | Brojanac | E05B 17/002 70/423 |
| 7,966,849 | B2 | * | 6/2011 | Wu | E05B 67/24 70/38 R |
| 10,801,233 | B2 | * | 10/2020 | Pedersen | E05B 17/183 |
| 2003/0196461 | A1 | * | 10/2003 | Liou | E05B 11/00 70/38 A |

* cited by examiner

PADLOCK WITH KEY-RETAINING COVER

CROSS-REFERENCE TO RELATED APPLICATIONS

Not applicable.

FIELD OF INVENTION

This disclosure relates to locks, and in particular, key-actuated padlocks for lockout devices.

BACKGROUND

Lockout devices, including padlocks and other lock types, are commonly used to temporarily restrict access to equipment and control instrumentation, electrical components, and fluid system components. These lockout devices can prevent incidental activation of controls during maintenance, help protect an operator from accidental contact with dangerous equipment, and/or prevent unauthorized persons from tampering with equipment or controls.

Some padlock-type devices incorporate key-actuated locking mechanisms which move blocking elements to selectively hold a movable loop-forming component (such as, for example, a wire, a curved bar, or shackle) in a closed position. The locking mechanisms commonly include multiple movable latching pieces (for example, pins, tumblers, wafers, or other movable parts) which are biased into a position to prevent the locking mechanism from being unlocked. To unlock these lockout devices, a key corresponding to the particular device must be used to engage the locking mechanism, thereby moving each of the latching pieces into a specific position to permit movement of the locking mechanism. Movement of the locking mechanism into an unlocked position clears the blocking elements and enables the loop-forming component to be moved into an open position, thereby enabling the removal or attachment of the device to one or more components.

SUMMARY

In linear locks, the key is inserted into the keyway in a direction parallel with the rotational axis of the lock cylinder. When the key is inserted, it displace pins or tumblers along this same axial direction to cause alignment of notches in the tumblers with another part of the locking elements (e.g., sidebars or locking wedges) to allow rotation of the lock cylinder when the correct key is inserted in order for the lock to be locked or unlocked.

Since the tumblers are biased opposite to the direction of insertion in a linear lock, one potential issue with a linear lock is that the key may not be easily retainable in the lock when the lock is not in use. Indeed, a key fully inserted into a linear lock may be forcibly ejected out of the keyway by rebound action of the multiple springs associated with the tumblers if a user is not careful to keep hold of the key.

Disclosed herein is an improved cover for access to a keyway in a linear lock which is designed to retain the key in its axial position within the lock even when there are counter-insertion biasing forces. While covers have existed for keyways in the past, such covers would merely block entrance of debris or of the elements (e.g., water) into the keyway. However, such covers have not been known to apply sufficiently high gripping strength to accommodate for key retention particularly in the context of linear lock structures.

According to one aspect, a padlock is disclosed that is configured to be locked and unlocked by a key. The padlock includes a lock body having an internal cavity with a locking mechanism received therein. The locking mechanism is a linear lock configured to receive the key through a keyhole to lock and unlock the padlock. A direction of insertion of the key into the locking mechanism is parallel with a direction of displacement of a plurality of tumblers in the locking mechanism, thereby creating an outward ejection force on a fully-inserted key. A cover is disposed on the locking mechanism proximate the keyhole. The cover being configured to retain the key in position relative to the locking mechanism against the outward ejection force after the key is received in therein.

In some forms, the cover may include a slot formed around the keyhole. At least one flexible wiper can extend from a side or sides of the access slot. The flexible wiper(s) can be configured to cover a portion of the keyhole before the key is inserted into the locking mechanism. The cover can also be configured and to grip the key after the key is inserted into the locking mechanism. Among other things, flexible wiper(s) may have a thickness selected to retain the key in the locking mechanism against the outward ejection force on the fully-inserted key. Alternatively or additionally, the surface(s) of the wiper(s) might be selected to provide additional frictional force to encourage retention of the key against the outward ejection force.

In some forms, the wiper(s) may be shaped to reflect the function they perform. For example, the wiper(s) may have a thickness that decreases along the length of the wiper (towards the slot) or may be axially tapered as they extend toward the locking mechanism.

In some forms, the wipers may include a first wiper extending from a first side of the slot and a second wiper extending from a second side of the slot opposite the first side. The first wiper and the second wiper may define a thin opening through the slot before the key is received in the locking mechanism. Then, when the key is inserted into the locking mechanism, the first wiper may be configured to be pushed outward toward the first side of the slot and the second wiper may be configured to be pushed toward the second side of the slot (effectively, outward and away from one another). Still yet, the first wiper and the second wiper, when deflected outward may be biased towards the key (for example, by virtue of their elastic deformation and desire to return to their non-deformed state) to retain the key in the locking mechanism against the outward ejection force.

Again in some forms, the flexible wiper(s) can apply a gripping force against the outward ejection force onto the key and it is contemplated that this gripping force may be a friction force between the wiper(s) and the key.

In some forms, the wiper(s) may be configured to be flexed in a radially-outward direction when the key is inserted into the locking mechanism.

In some forms, the padlock may include a faceplate which may be configured to restrict axial deflection of the at least one flexible wiper away from the locking mechanism between which faceplate and locking mechanism the cover is disposed.

As such, there may be faceplate which may be disposed on an axial end of the cover opposite the locking mechanism. This face plate may wrap around a portion of the cover and/or may retain the cover on the locking mechanism. Similarly, in some forms, the cover may include at least one protrusion which may be configured to be received by the locking mechanism. Among other things, this can rotationally couple the cover and the locking mechanism together.

In some forms, the cover may be a polymer or elastomeric material.

In some forms, in addition to provide structure that assists in retaining the key in the passageway, the cover may selectively inhibit entry of debris into the locking mechanism.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1:
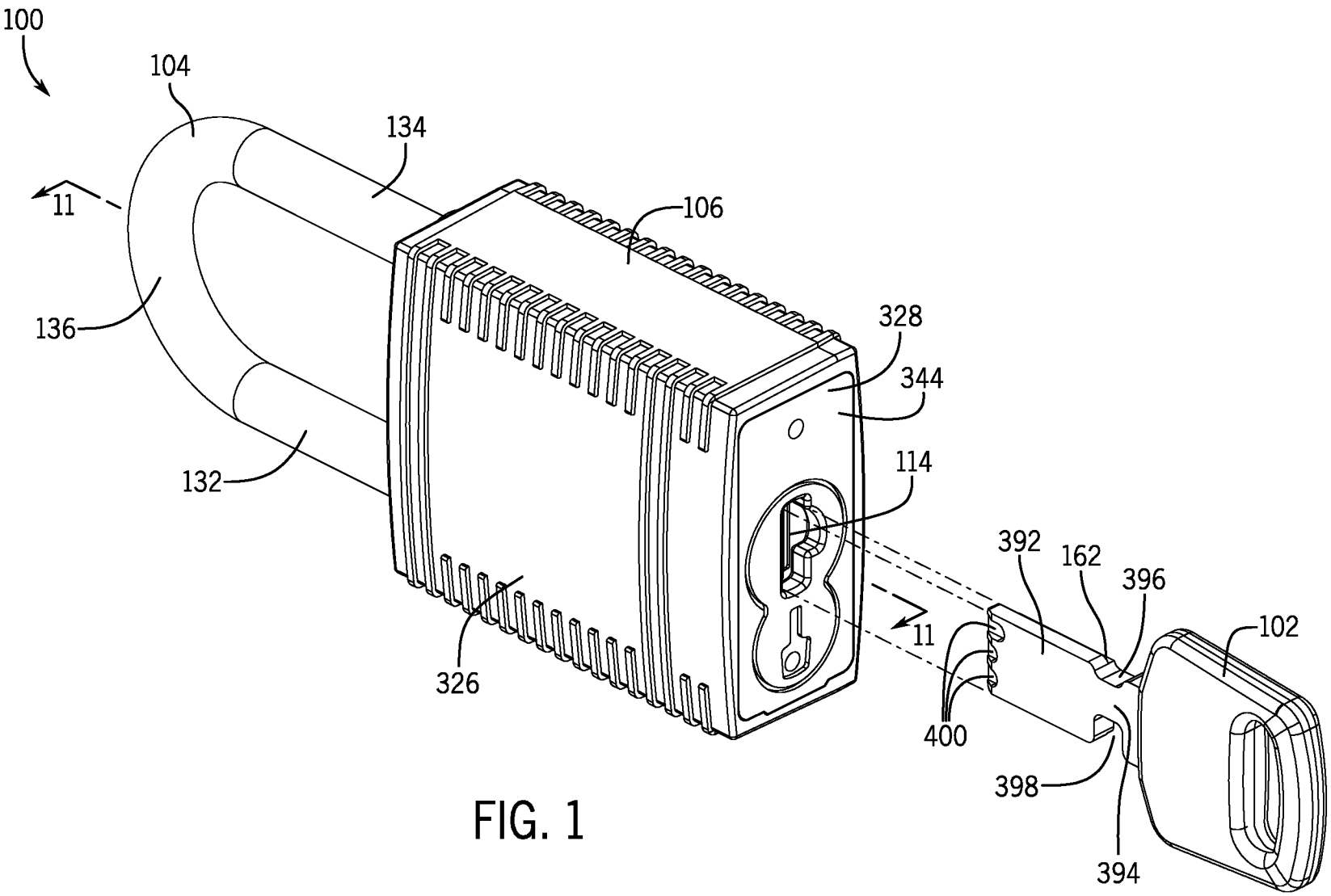
FIG. 1 is a perspective view of a padlock with a key for unlocking the padlock.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
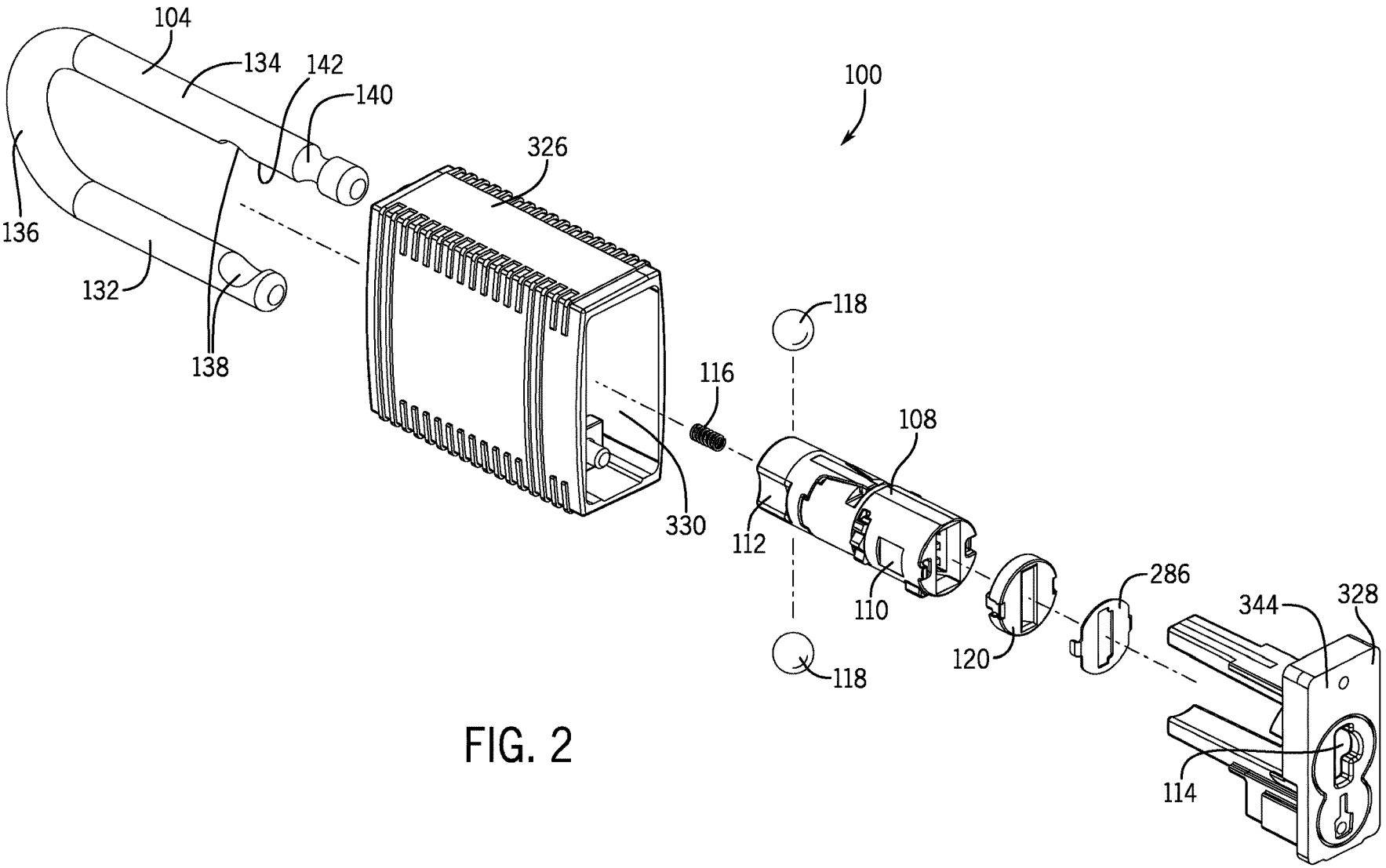
FIG. 2 is an exploded perspective view of the padlock of FIG. 1.

Referring first to FIGS. 1-2, a padlock 100 configured to be locked and unlocked with a key 102 corresponding to the padlock 100 is illustrated. Notably, this padlock 100 is a linear lock, meaning that the pins or tumblers within the lock are displaced in a direction parallel to the direction of key insertion or extraction. The padlock 100 includes a shackle 104 secured to a lock body 106 and movable between an open position and a closed position. In the open position, one end of the shackle 104 is received in the lock body 106 while another end of the shackle 104 is disengaged from the lock body. In the closed position, both ends of the shackle 104 are received by the lock body 106. A locking mechanism 108 is internally received by the lock body 106 and includes a lock cylinder 110 configured to receive the key 102 and a cam 112 integrally connected to the lock cylinder 110. The lock body 106 includes a keyway 114 that provides access to the lock cylinder 110 by the key 102, and a cam spring 116 that biases the locking mechanism 108 towards the keyway 114 to maintain stack-up tolerances for a predictable insertion depth when the key is inserted into the lock cylinder 110.

When received in the lock cylinder 110, the key 102 is configured to rotate the locking mechanism 108 over a range of positions that includes a locked position and an unlocked position (by virtue of aligning the tumblers to permit the rotation of the lock cylinder 110 and cam 112 within the lock body 106 as will be described in greater detail below). In the locked position, the cam 112 is shaped and configured to hold two ball bearings 118 (more generally, blocking elements) in engagement with the shackle 104, thereby inhibiting movement of the shackle 104 between the open and closed positions. In the unlocked position, the cam 112 is configured and shaped to at least partially allow the ball bearings 118 to disengage the shackle 104 so that it can freely move between the open and closed positions.

In addition to the above features, the keyway 114 is configured to provide an angular rotational stop to the key 102, limiting the range of angular positions over which the locking mechanism 108 may be rotated. The keyway 114 also configured to retain the key 102 in the lock body 106 in all but one rotational position of the range of rotational positions.

The padlock 100 also includes a cylinder cover 120 that is configured to retain the key 102 in the locking mechanism 108 and prevent the ingress of debris into the key passageway of the locking mechanism 108. The cylinder cover 120 is positioned between the locking mechanism 108 and the keyway 114 and can grip the key 102 to resist an outward ejection force acting on the key 102.

As illustrated, the shackle 104 has a generally U-shaped body including a short shaft 132 and a long shaft 134 extending from opposite ends of a curved section 136. The short shaft 132 and the long shaft 134 are substantially parallel, and each includes a latching notch 138 formed in opposite interior sides such that the latching notches 138 face each other. While the latching notch 138 on the short shaft 132 is positioned proximate the axial end thereof, the long shaft 134 extends further from the curved section 136 than the short shaft 132 and includes a retention groove 140 formed circumferentially proximate its respective axial end. Each of the latching notches 138 are formed at the same depth into the sides of the shackle 104. The retention groove 140, on the other hand, is shallower than the latching notches 138 and does not extend as far into the shackle 104. The long shaft 134 also includes a recessed face 142 extending between the retention groove 140 and the latching notch 138. The recessed face 142 has a generally planar surface formed into the inward facing side of the long shaft 134 at a depth which is less than that of the latching notches 138 and the retention grove 140. While a rigid U-shaped shackle is found in the illustrated embodiment, other shackle configurations and geometries might be employed.

Referring now to FIGS. 3-7, structural details of the locking mechanism 108 will now be described in greater detail.

Figure 5:
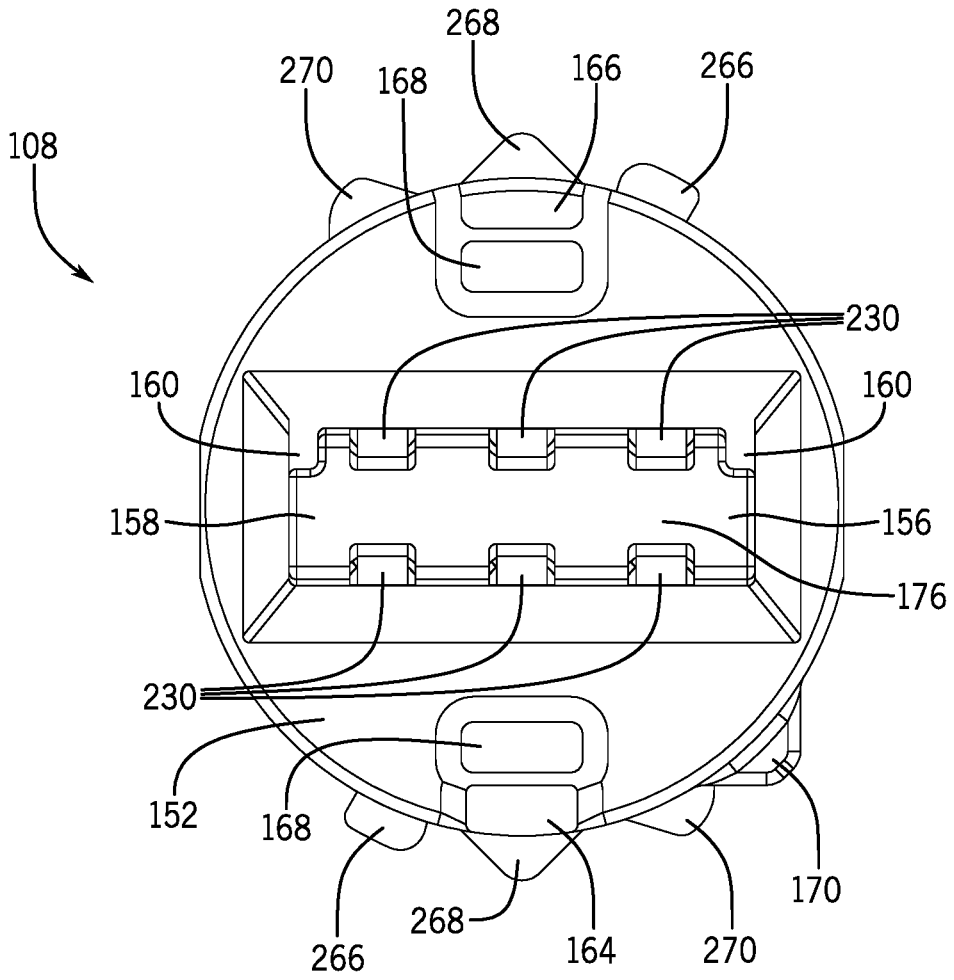
FIG. 5 is a bottom-up plan view of the locking mechanism of FIG. 3 without the cylinder cover or faceplate.

The locking mechanism 108 includes the lock cylinder 110 which has a substantially circular cross section and axially extends from a key-receiving end 152 to a cam-attachment end 154 opposite the key-receiving end 152. A keyhole 156 is formed through the key-receiving end 152 and provides access to a forward cylinder cavity 158 formed within the lock cylinder 110. As shown in FIG. 5, the keyhole 156 has a generally rectangular profile with two indented corners 160 that correspond to recessed corners 162 formed in key 102 (which corners 162 best seen in FIG. 18) so that the key 102 can only be inserted in one orientation. The key-receiving end 152 also includes a slot 164 formed proximate a circumferential edge thereof, and a tab 166 projects outwardly from the key-receiving end 152 and is positioned proximate the circumferential edge opposite the slot 164. The key-receiving end 152 also includes two openings 168 formed therein, with one opening 168 being positioned adjacent each of the slot 164 and the tab 166. Further, a rotational stop 170 having a generally triangular cross section projects radially outward from the circumferential side of the lock cylinder 110 proximate the key-receiving end 152 thereof.

Figure 4:
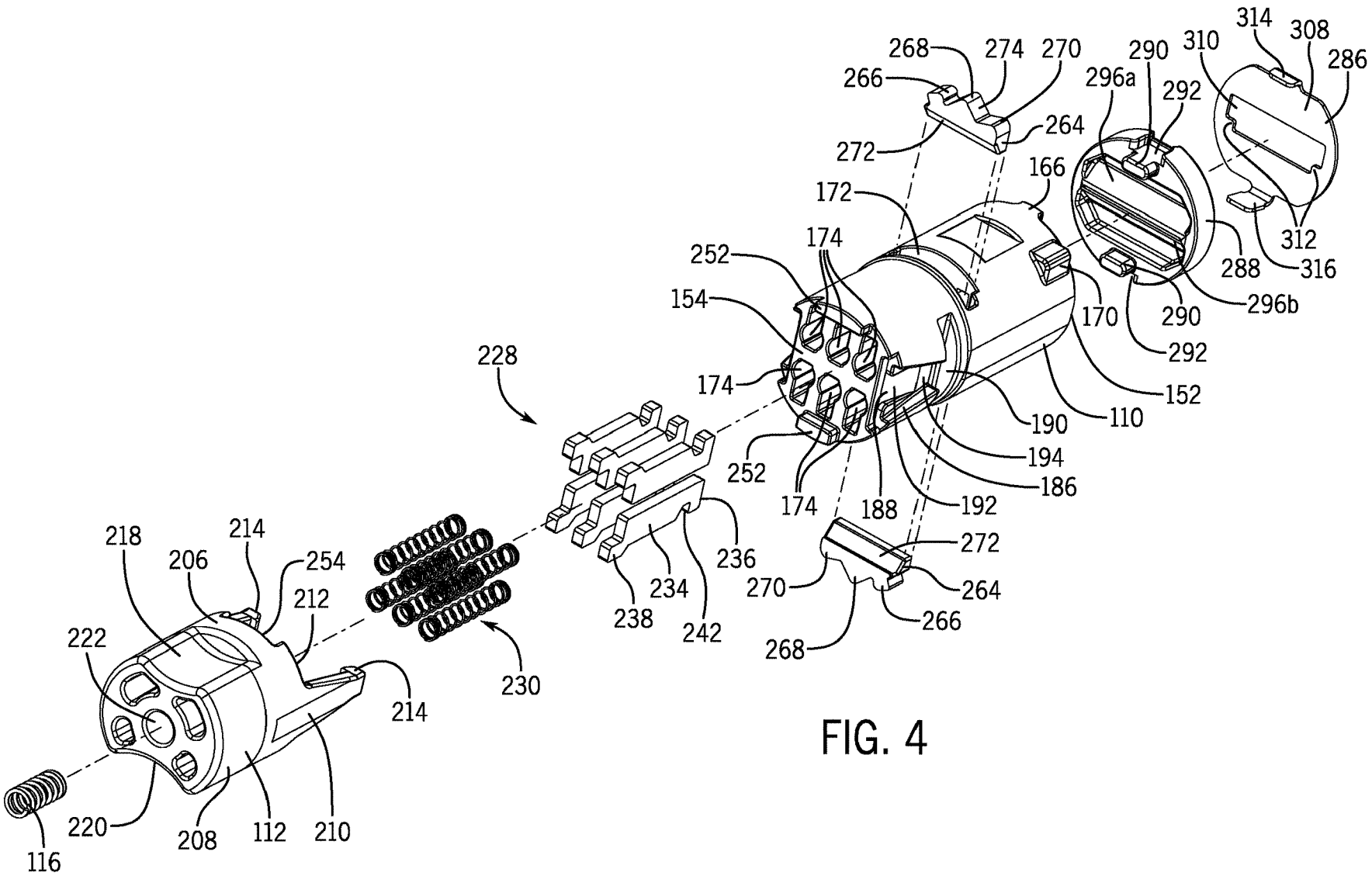
FIG. 4 is an exploded perspective view of the locking mechanism with the cylinder cover and faceplate of FIG. 3.
Figure 6:
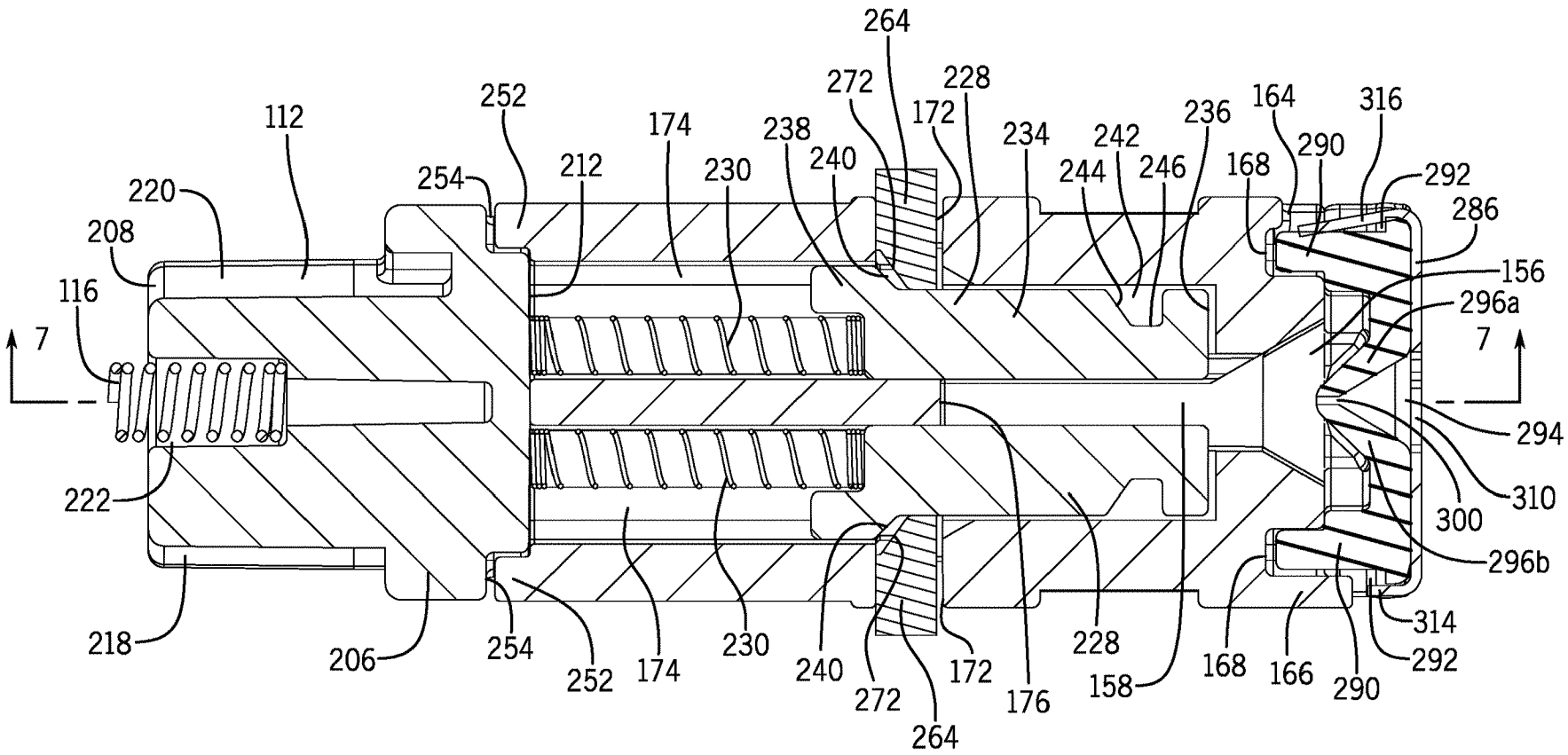
FIG. 6 is a side cross-sectional view of the locking mechanism with the cylinder cover and faceplate of FIG. 3.

As illustrated in FIGS. 4 and 6, two lateral slots 172 extend through opposite sides of the lock cylinder 110 in a plane perpendicular to the axis of the lock cylinder 110 and a plurality of tumbler slots 174 are formed through the cam-attachment end 154 in a direction parallel with its central axis. Each tumbler slot 174 extends from the cam-attachment end 154, through the lock cylinder 110, past the lateral slots 172 (which they are generally perpendicular to) and into the forward cylinder cavity 158. The tumbler slots 174 are arranged in two rows that are perpendicular to the lateral slots 172 and bisected by a key stop 176 which extends across the lock cylinder 110 and defines an axial boundary of the forward cylinder cavity 158. Each tumbler slot 174 has a rectangular profile that extends away from the key stop 176 and connects with one of the lateral slots 172 so that the tumbler slots 174 are accessible through the lateral slots 172.

Two channels 186 are formed on opposite sides of the lock cylinder 110 to facilitate attachment of the cam 112. Each channel 186 has a generally trapezoidal shape that narrows between a channel opening 188 formed in the cam-attachment end 154 and a notch 190 cutting across the side of the lock cylinder 110. The channels 186 also includes an inclined section 192 which tapers radially outward between the channel opening 188 and a flat section 194 proximate the notch 190. The notches 190 are formed at the same depth as the channel openings 188, resulting in a steep drop-off between the surfaces of the flat sections 194 and the notches 190.

Figure 7:
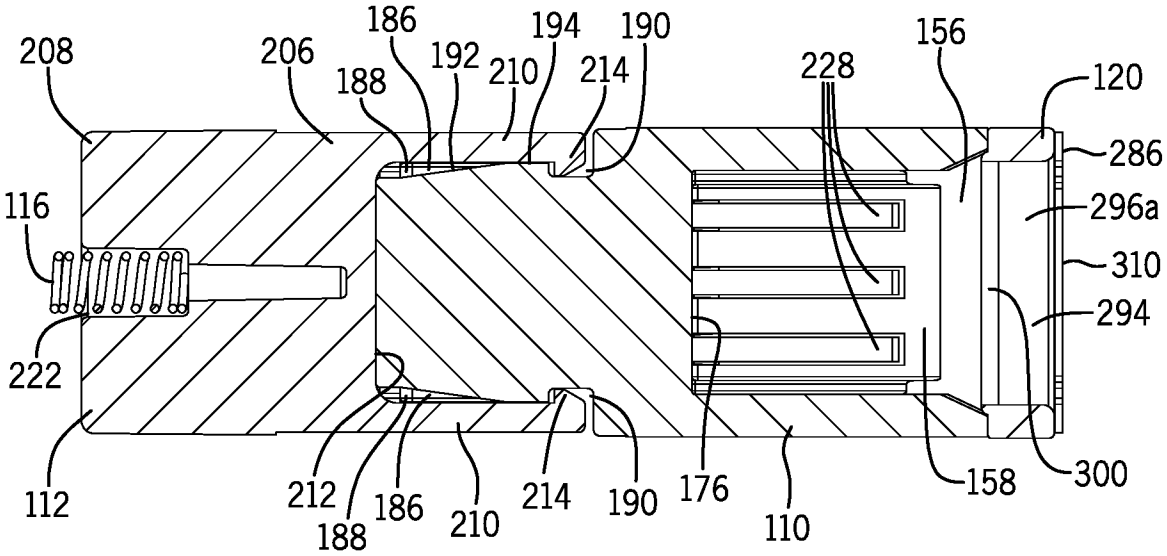
FIG. 7 is a front cross-sectional view of the locking mechanism with the cylinder cover and faceplate of FIG. 3.

With particular reference to FIGS. 4 and 7, structural details of the cam 112 will now be described. The cam 112 includes a cam base 206 with a circular cross section that is substantially the same as that of the lock cylinder 110, a bearing-engaging section 208, and two coupling arms 210. The coupling arms 210 are positioned at opposite circumferential edges of a cylinder-attachment end 212 of the cam base 206 and project outwardly therefrom in a direction generally parallel to the central axis. A finger 214 is positioned proximate the end of each coupling arm 210 and extends radially inward toward the opposite coupling arm 210. The profile of the coupling arms 210 is generally trapezoidal and has a width that tapers inward between the cam base 206 and the finger 214 (corresponding to the shape in the end of the lock cylinder 110).

At an opposite axial end of the cam 112, the bearing-engaging section 208 includes a cam spring opening 222 formed centrally relative to the circular cross section of the cam base 206. Two cam recesses—a shallow cam recess 218 and a deep cam recess 220—are formed in opposite sides of the bearing-engaging section 208. Both of the cam recesses 218, 220 define a concave outer surface that curves inward in a substantially continuous arc in-between two points on the otherwise circular profile of the bearing-engaging section 208. Although the curvature of the deep cam recess 220 is defined by an arc having the same curve radius as the curvature of the shallow recess 218, the concave curve of the deep recess 220 has a longer arc length and, therefore, extends closer to the cam spring opening 222 that the shallow recess 218.

Looking back to the lock cylinder 110, the tumbler slots 174 are each configured to receive a tumbler 228 and a tumbler spring 230 through a corresponding tumbler slot opening in the cam-attachment end 154. Each tumbler 228 is substantially planar and has a tumbler shaft 234 extending from a forward end 236 to an offset tab 238 opposite the forward end 236. The offset tab 238 extends from a corner the tumbler 228 such that it extends laterally past one side of the tumbler shaft 234, increasing the overall width of the tumbler 228. The body of each tumbler 228 tapers outward from the side of the tumbler shaft 234 to the side of the offset tab 238, providing an angled surface 240 therebetween (see FIG. 6). Additionally, the tumblers include a tumbler notch 242 formed in the side of the tumbler shaft 234 at a position between the forward end 236 and the offset tab 238. The tumbler notch 242 includes an inclined end 244 which faces the forward end 236 and tapers outward from a base side 246, which defines the depth of the tumbler notch 242, to the side of the tumbler shaft 234.

While the illustrated embodiments depicts a tumbler notch formed in at same position on all of the tumblers, it should be understood that some embodiments can have at least one tumbler with a tumbler notch that is formed closer to the forward end or the spring positioning tab that at least one of the other tumblers. For example, most locking mechanisms will have a set of tumblers with most of the tumblers having tumbler notches formed at different or varying positions along each shaft. By including tumblers with notches formed at a variety of different positions, a locking mechanism can be "coded" for use with a specific corresponding key.

Figure 3:
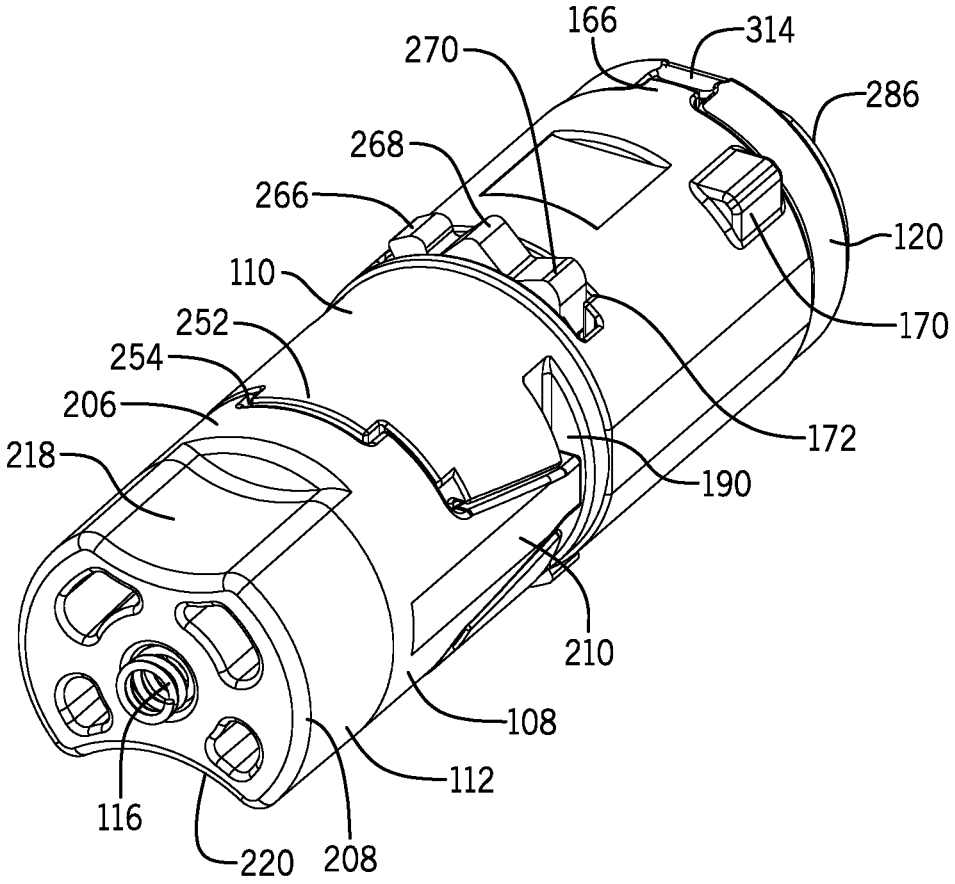
FIG. 3 is a perspective view of the locking mechanism with the cylinder cover and faceplate from the padlock of FIG. 1.

As best illustrated in FIGS. 3 and 7, each of the coupling arms 210 is configured to engage one of the channels 186 on the lock cylinder 110, thereby integrally connecting the cam 112 to the lock cylinder 110 at the cam-attachment end 154 of the lock cylinder 110. More specifically, the coupling arms 210 can be slid into the channels 186 through the channel openings 188 so that the lock cylinder 110 is secured between the coupling arms 210. As the coupling arms 210 are inserted into the channels 186, the inclined sections 192 press against the fingers 214, temporarily flexing the coupling arms 210 outward to allow continued insertion thereof. Once the fingers 214 reach the notches 190 at the ends of the channels 186, the coupling arms 210 return to the unflexed position, dropping the fingers 214 into the notches 190 and securing the two components together.

When the fingers 214 are received in the notches 190, axial movement of the cam 112 relative to the lock cylinder 110 is limited to a range equal to the difference between an axial width of the notches and that of the fingers 214. Further, abutment between the coupling arms 210 and the channels 186 constrains rotational, lateral, and longitudinal (i.e., axial) motion of the cam 112 relative to the lock cylinder 110. Movement of the cam 112 relative to the lock cylinder 110 is also constrained by engagement between at least one of the tabs 252 extending from the cam-attachment end 154 of the lock cylinder and a corresponding recess 254 formed in the cylinder-attachment end 212 of the cam 112.

In some embodiments, at least one of the coupling arms can have a shape which does not correspond to the shape of the channel. For example, a coupling arm can have a linear shape that does not taper inward. A locking mechanism can also include a coupling arm and a channel that are both generally straight and without a tapering surface. At least one channel can also omit at least one of the inclined section or a flat section at the end of the inclined section. In still another embodiment, at least one channel can be omitted altogether and a coupling arm can engage the outer surface of the lock cylinder.

In still more embodiments, the cam can be coupled to the lock cylinder in a different way. For example, a mechanical fastener or an adhesive can be used to secure the cam to the locking mechanism. In another embodiment, at least one coupling arm can include an opening configured to engage a portion of the lock cylinder. A peg, a latch, of or any other projection can extend outward from the side of the lock mechanism in to engage the coupling arm. In another example, a fastener, such as a screw or a bolt, or a separate peg can extend through openings formed in the coupling arm and the cam or the lock cylinder to connect the two components. A locking mechanism can also include coupling arms, or any other coupling feature, that can be slid or twisted into engagement with the lock cylinder or the cam.

In some embodiments, at least one of coupling arms can be included on the lock cylinder and be configured to be received in a channel formed in the cam. A different number and arrangement of coupling arms and channels can also be used. In some embodiments, a cam can include one coupling arm configured the engage the lock cylinder and the lock cylinder can have two coupling arms configured to engage the cam.

Returning to FIGS. 4-7, each tumbler 228 is configured to be received in one of the tumbler slots 174 and is inserted prior to the attachment of the cam 112 to the lock cylinder 110. When received in the tumbler slots 174, the forward ends 236 of the tumblers 228 the tumbler notch 242 faces the lateral slot 172 linked with said tumbler slot 174. Further, the tumblers 228 can slide towards or away from the keyhole 156 (i.e., in a direction parallel to a direction of insertion of the key). In the illustrated embodiment, a tumbler spring 230 is inserted into the tumbler slots 174 behind the tumblers 228 so that the tumbler spring 230 abuts an end of a tumbler 228 adjacent the offset tab 238. The tumbler springs 230 are configured to bias the tumblers 228 towards the keyhole 156 and into a key-out position where the tumbler shafts 234 extend into the forward cylinder cavity 158 so that the tumbler notches 242 are positioned between the keyhole 156 and the lateral slots 172. As will be described in more detail with respect to FIGS. 14 and 16-19, the tumblers 228 are selectively movable by the key 102 to a key-in position in which the tumblers 228 are pushed away from the keyhole 156 so that the tumbler notches 242 are drawn into alignment with the lateral slots 172 when the corresponding key is inserted.

In some locking mechanisms, at least one of the tumblers can be different than at least one of the other tumblers. For example, two of the tumblers may be rectangular, one tumbler can be triangular, and the remaining tumblers can be circular. Similarly, at least one tumbler slots may be different that at least one of the other tumbler slots, and may have a shape that does or does not conform to the tumbler received therein. In another embodiment, a locking mechanism can include more or less tumblers than the illustrated embodiment. For example, a first row of tumblers can include two tumblers and a second row of tumblers can include 5 tumblers. A locking mechanism can also include more or less lateral slots or rows of tumblers. Some embodiments, for example, can include three rows of tumblers corresponding to four different lateral slots. A different locking mechanism can include a plurality of tumblers facing radially outward from the center of the lock cylinder and which are not arranged in any rows.

Notably, in the illustrated embodiment, the cylinder-attachment end 212 of the cam 112 effectively provides a "cap" on the end of the lock cylinder 110 to define a portion of the volume receiving the tumblers and/or the springs or at least provides an axial end of the volume. Thus, when the cam 112 is attached to the lock cylinder 110, the cam 112 itself provides a constraint to the tumbler springs 230, compressing the tumbler springs 230 to apply a tumbler-biasing force to the tumblers 228. When the key 102 is received in the locking mechanism 108, the tumbler-biasing force is transferred to the key as an outward ejection force against the insertion of the key.

Looking at FIGS. 3, 4, and 6, the locking mechanism 108 further includes two movable stops 264 configured to be received in the lateral slots 172 of the lock cylinder 110 and which, can restrict or enable rotation of the lock cylinder 110 relative to the lock body 106. Each movable stop 264 includes a plurality of fingers 266, 268, 270 extending from a side opposite an angled surface 272 which slopes from the top of the movable stop 264 towards the bottom. The fingers 266, 268, 270 each have a different shape and collectively define a stop profile including multiple different curved sections and linear sections. As will be described in greater detail with respect to FIGS. 10 and 12, the fingers 266, 268, 270 are configured to selectively be engaged with the lock body 106.

Figure 23:
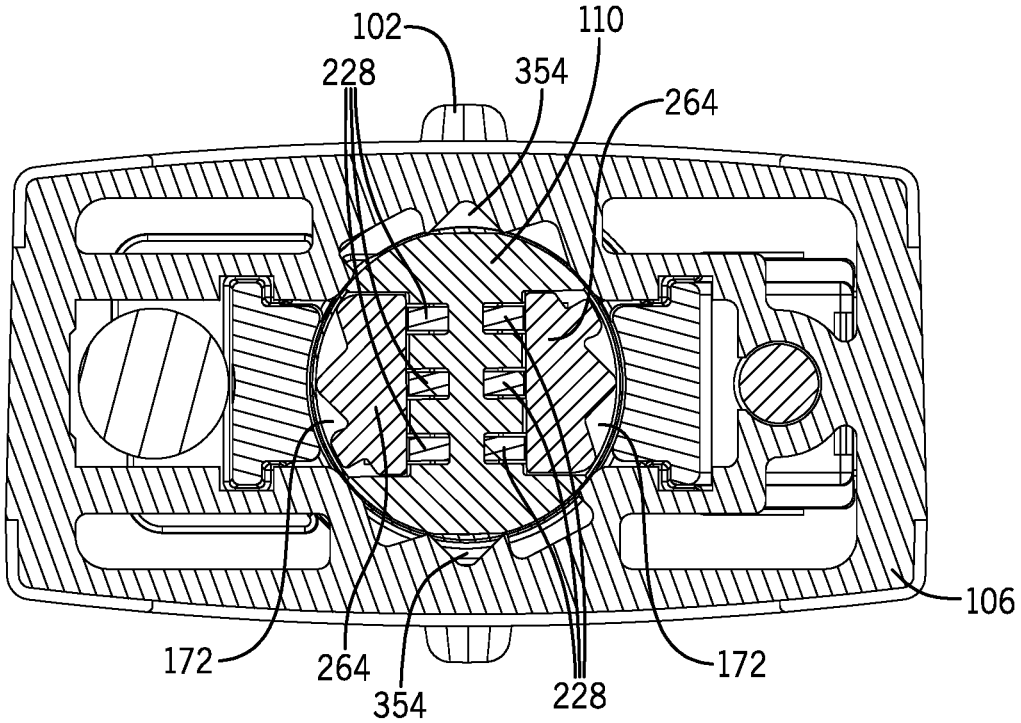
FIG. 23 is another top down cross-sectional view of the padlock and key taken through line 23-23 of FIG. 20.

The movable stops 264 are configure to be inserted into the lateral slots 172 of the lock cylinder 110 so that, when the tumblers 228 in the key-out position (which is their default position), the ends of the each angled surface 272 abuts the side of the tumbler shaft 234 and the fingers 266, 268, 270 protrude out of the lateral slots 172 beyond the circumferential periphery or profile of the lock cylinder 110. However, as will be described in more detail with respect to FIGS. 19 and 23, the movable stops 264 is configured to move inward to fit within the profile of the lock cylinder 110 when the tumbler notches 242 are in alignment with the lateral slots 172.

In embodiments of the padlock which utilize more or less lateral slots than the illustrated padlock, the locking mechanism can use more or less movable stops according to the number of lateral slots. In other embodiments, more than one movable stop can be received in at least one lateral slot. At least of movable stop can also include a different number of fingers that at least one other movable stop. For example, some locking mechanisms can have one movable stop with two fingers and two movable stops with four fingers Referring now to FIGS. 4-5 and 7-10, details of the cylinder cover 120, including a faceplate 286, will be described. The cylinder cover 120 is configured to be disposed on the key-receiving end 152 of the lock cylinder 110. Similarly to the cam 112, the cylinder cover 120 includes a cover body 288 with a substantially circular cross section corresponding to the cross section of the locking mechanism 108. Two cover tabs 290 are positioned proximate opposite circumferential edges of the cover body 288 and extend axially outward therefrom. The cover tabs 290 correspond to the openings 168 formed in the key-receiving end 152 of the lock cylinder 110 and are configured to be received therein to couple the cylinder cover 120 to the lock cylinder 110. A cover channel 292 is formed in the side of the cover body 288 adjacent each of the cover tabs 290 and is configured to receive at least a portion of the cylinder tabs 166 projecting from the key-receiving end 152.

Figure 8:
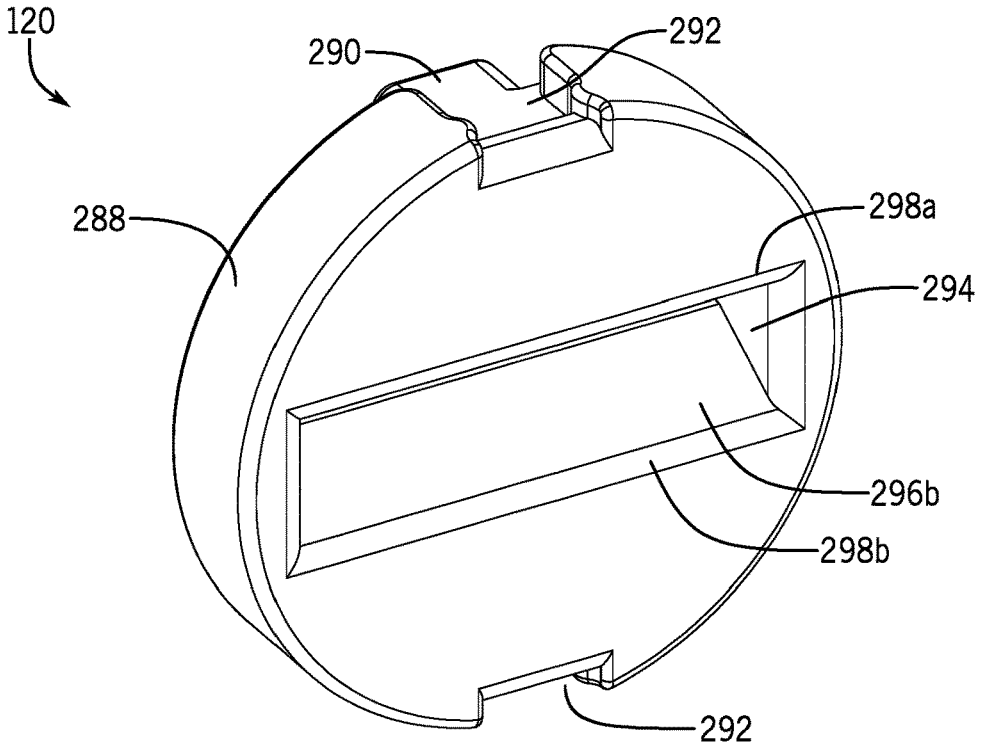
FIG. 8 is a perspective view of the cylinder cover of FIG. 4.
Figure 9:
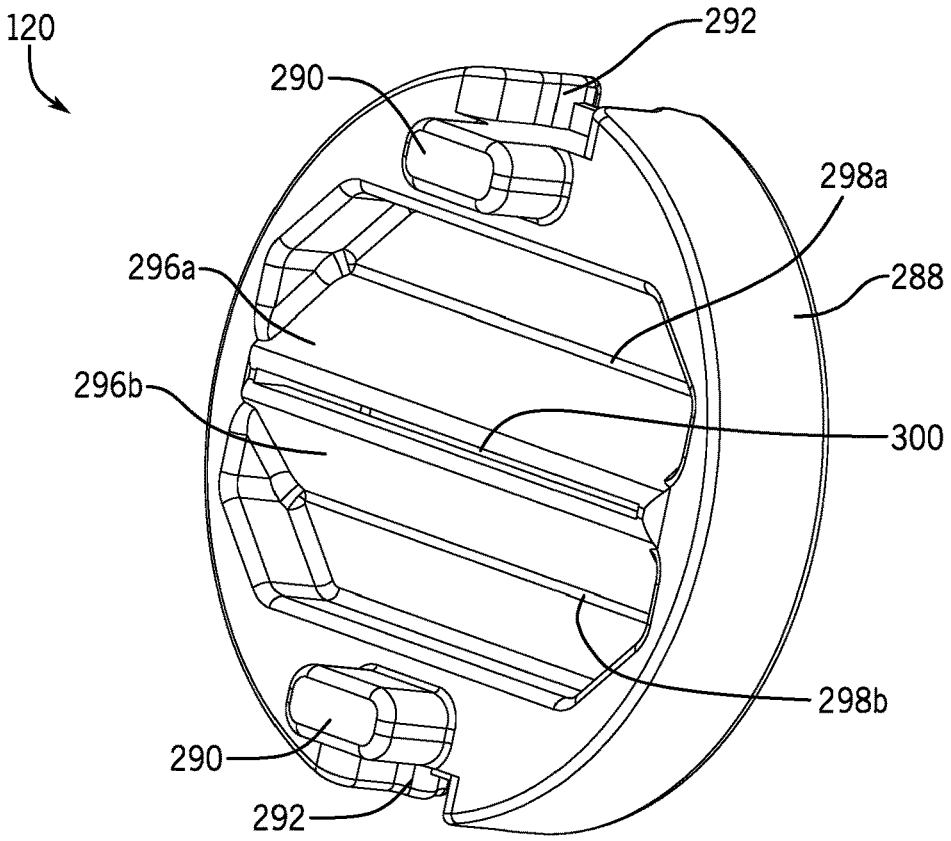
FIG. 9 is another perspective view of the cylinder cover of FIG. 8.

As illustrated in FIGS. 6 and 8-9, the cylinder cover 120 includes an access slot 294 formed through the cover body 288 to provide access to the keyhole 156 through the cylinder cover 120. Some embodiments of a cylinder cover can include a wiper extending from at least one side of the access slot 294 towards the opposite side. In the illustrated embodiment, for example, a first wiper 296*a* extends from a first side 298*a* of the access slot 294 and a second wiper 296*b* extends from a second side 298*b* opposite the first side 298*a*. The wipers 296*a*, 296*b* are made from a flexible materials and can flex between an unflexed position and a flexed position without breaking. In the unflexed position, the wipers 296*a*, 296*b* extend radially inward towards each other and taper radially inward in the axial direction toward the cover tabs 290. The wipers 296*a*, 296*b* converge on a central opening 300 providing only a narrow passage through the access slot 294. Further, the thickness of the wiper 296*a*, 296*b* decreases between the respective one of the sides 298*a*, 298*b* of the access slot 294 and the edges of the wipers 296*a*, 296*b* at the periphery of the central opening 300.

Figure 17:
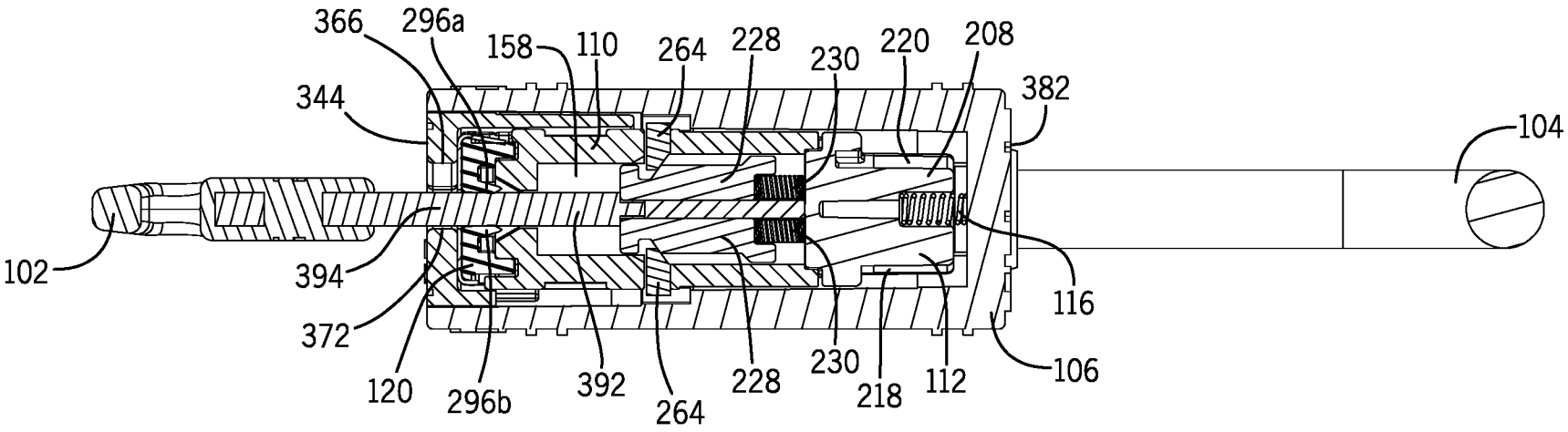
FIG. 17 is a side cross-sectional view of the padlock and key taken through line 17-17 of FIG. 16.

As is illustrated in FIG. 17, the wipers 296*a*, 296*b* can be moved into a flexed position when the key 102 is inserted into the access slot 294. In the flexed position, the wipers 296*a*, 296*b* are flexed outward and away from the each other, thereby expanding the central opening 300 so that the key 102 can pass through. However, the wipers 296*a*, 296*b* are not permanently deformable by the key 102 and can be configured to naturally return to the unflexed position after the key is removed from the access slot 294. Prior to the removal of the key 102, however, the wipers 296*a*, 296*b* press against the key 102, squeezing it from opposite sides. The resulting friction between the wipers 296*a*, 296*b* and the key 102 provides a gripping force that resists movement of the key 102 against the ejection force of the tumbler springs 230. In some embodiments, the strength of the gripping force can be a function of at least one of the thickness of the wipers 296*a*, 296*b* or the material from which the wipers 296*a*, 296*b* are composed.

Still further, it should be appreciated that these wipers 296*a* and 296*b* generally prevent the ingress of debris into the key passageway by sealing shut when no key is received through the cylinder cover 120.

Some embodiments of the cover can include a different number of wipers than the illustrated embodiment achieving the same ejection-inhibiting effect of the key within the linear lock. For example, there could be one wiper extending partially or all the way across the access slot, or four wipers, each extending from a different one of the access slots. Other embodiments can include at least one wiper that is different than at least one other wiper. For example, at least one wiper could be rigid and spring loaded. A wiper could also be configured to slide or move radially outward without axial movement, or to be compressible.

Referring to FIGS. 4 and 6, the faceplate 286 is configured to be disposed on a side of the cylinder cover 120 opposite the lock cylinder 110. The faceplate 286 includes a generally circular plate body 308 with a plate keyhole 310 formed through the centered of the plate body 308 to be aligned with the keyhole 156 in the lock cylinder 110. Similarly to the keyhole 156 of the lock cylinder 110, the plate keyhole includes two indented corners 312 corresponding to the recessed corners 162 on the key. A short faceplate tab 314 and a long faceplate tab 316 extend axially outward from opposite side of the plate body 308 and engage the cover channels 292, thereby securing the faceplate 286 to the cylinder cover 120. Further, the long faceplate tab 316 can be configured to squeeze the cover tabs 290 against the sides of lock cylinder 110 to hold the cylinder cover 120 in position. In some embodiments, the face plate may be integrally formed with the cover and can omit at least one tab, or include at least one additional tab. Further, some padlocks can use a rigid member other than a plate to prevent outward flexing of at least one wiper. Accordingly, when assembled, the faceplate 286 rotationally travels with the cylinder cover 120 which rotationally travels with the lock cylinder 110.

Figure 10:
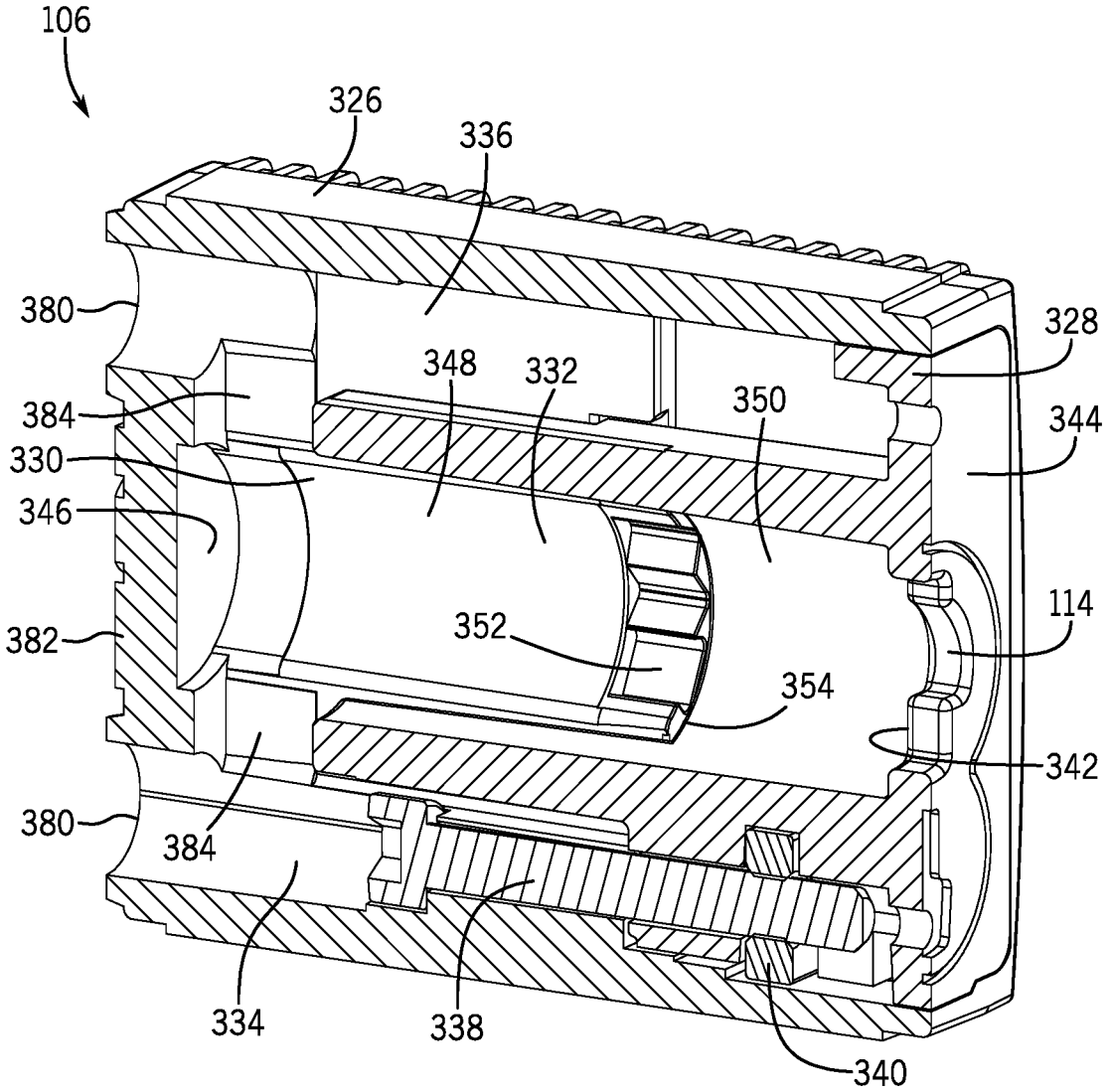
FIG. 10 is a perspective cross-sectional view of the lock body of FIG. 1.
Figure 11:
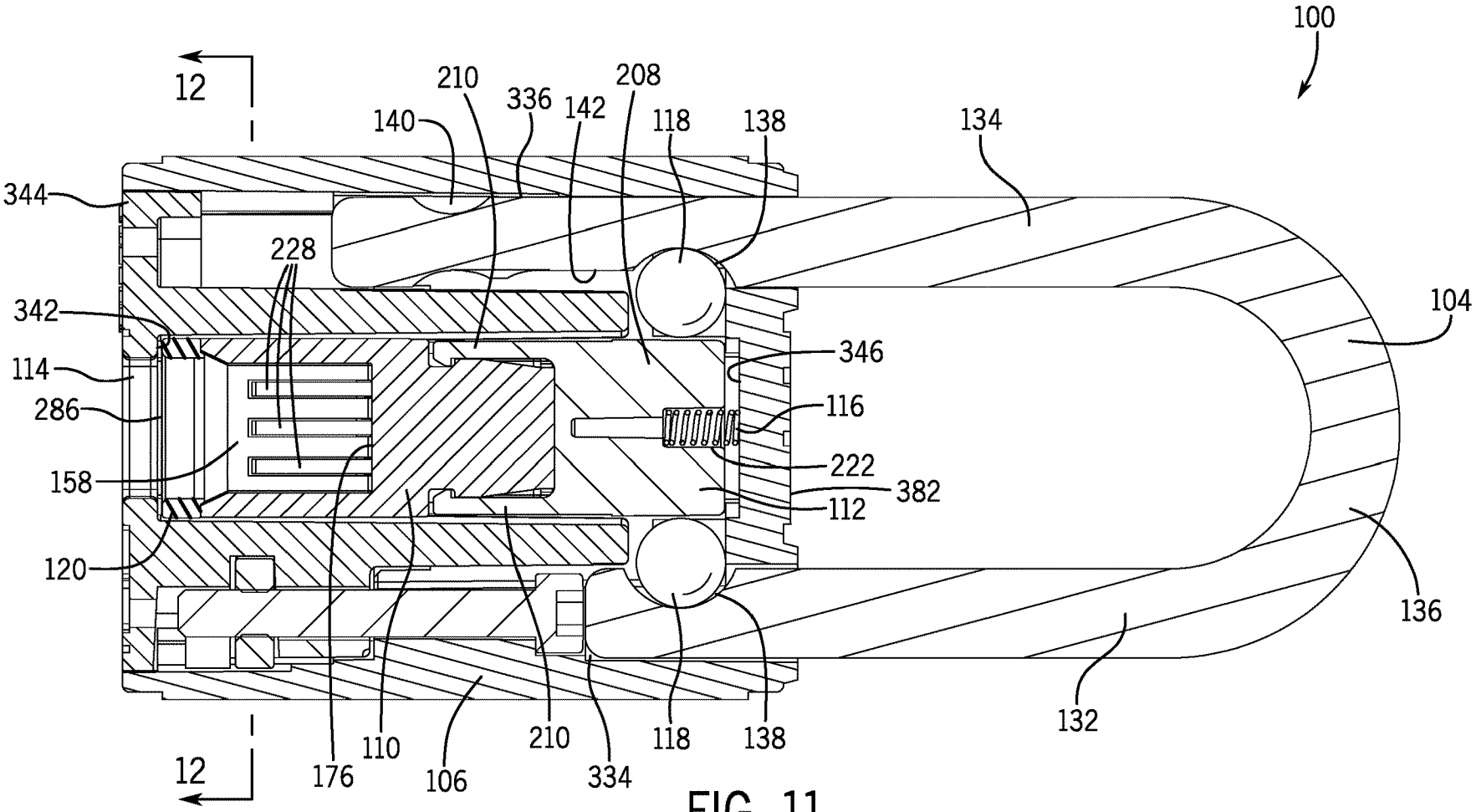
FIG. 11 is a front cross-sectional view of the padlock of FIG. 1 with the shackle in the closed position.

Keeping the structural details of the locking mechanism 108 and the cylinder cover 120 in mind, details of the lock body 106 and the assembled padlock 100 can be described with reference to FIGS. 10-13. As best shown in FIG. 10 (and the exploded view of FIG. 2), the lock body 106 includes an enclosure 326 and an enclosure base 328 that collectively define an internal cavity 330 and a subset of regions therein, including a central chamber 332 configured to house the locking mechanism 108 and two shackle slots 334, 336. In the illustrated embodiment, the enclosure base 328 is configured to be secured to the enclosure 326 with a bolt 338 and a nut 340 which is only accessible when the short end 132 of the shackle 104 is removed from the lock body 106.

In other embodiments, other methods of joining an enclosure and an enclosure base may be used. For example a different mechanical fastener or even an adhesive might be used to secure an enclosure to an enclosure base. In some embodiments, a lock body can be divided into a different set of components. At least one different side of the lock body can be detachable, or the body can be broken into halves or two or more large pieces with different proportions.

Referring to FIG. 10, the central chamber 332 is substantially cylindrical and extends from a key-receiving axial end 342 at the key-receiving side 344 of the lock body 106, to an interior axial end 346 opposite the key-receiving axial end 342. The central chamber 332 is formed from an inward section 348 provided primarily by the sides of the enclosure 326, and a forward section 350 provided by the sides of the enclosure base 328. The inward section 348 and the forward section 350 of the central chamber 332 provide cylindrical cavities that are concentrically positioned and have the same diameter. The enclosure 326 includes two finger-receiving recesses 352 formed into opposite sides of the inward section 348 and positioned at the periphery of a gap 354 separating the forward section 350 from the inward section 348 of the central chamber 332.

As previously mentioned, the central chamber 332 is configured to house the locking mechanism 108 with the cylinder cover 120 and faceplate 286 attached. Looking at FIGS. 11 and 12, the locking mechanism 108 can be received in the central chamber 332 with the keyhole 156 of the lock cylinder 110 (as well as the cylinder cover 120 and faceplate 28) facing the keyway 114 through the key-receiving axial end 342. The cam 112 is configured to be positioned proximate the interior axial end 346 such that the bearing-engaging section 208 is aligned with the adjoining passages. The fingers 266, 268, 270 of the movable stops 264 are configured to selectively extend into and engage the finger-receiving recesses 352, which have a profile corresponding to the stop profile 274 as best illustrated in FIG. 12.

Figure 12:
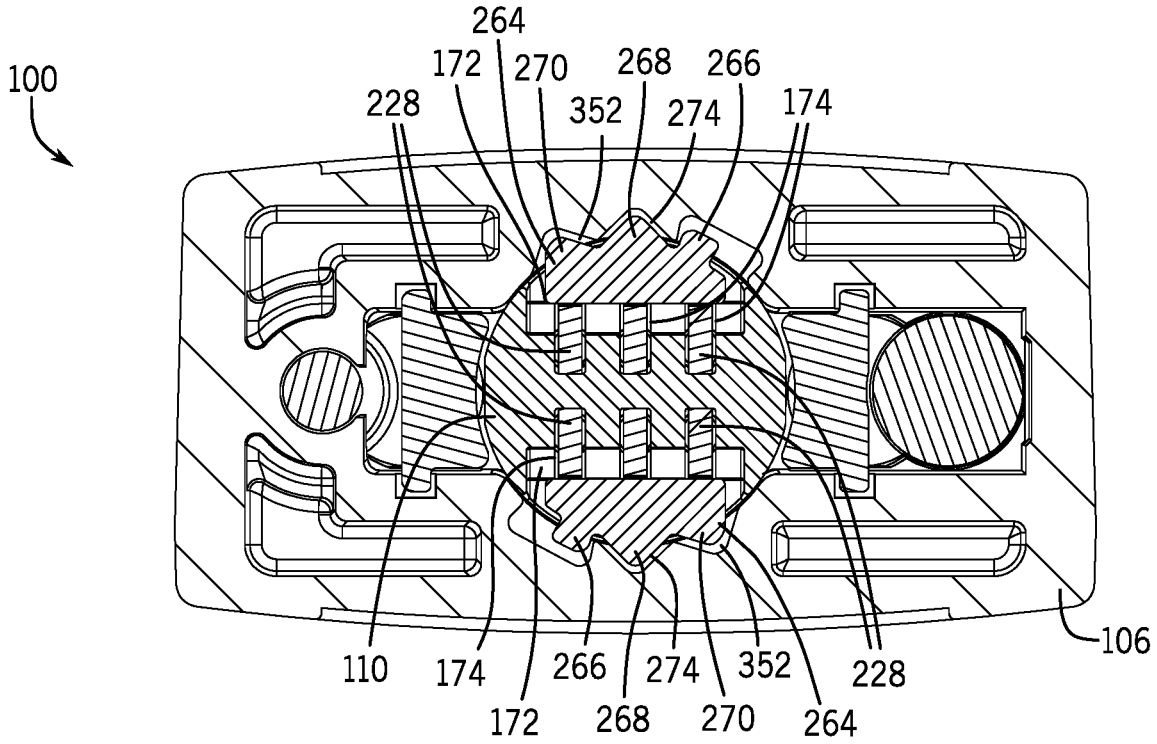
FIG. 12 is a top down cross-sectional view of the padlock of FIG. 11 taken through line 12-12 with the key inserted into the padlock.

When the tumblers 228 are in the key-out position, as shown in FIG. 12, the tumbler shafts 234 of the tumblers 228 push the movable stops 264 radially outward in the lateral slots 172 into the finger-receiving recess 352 of the lock body 106. In this position, the tumblers 228 block inward motion of the movable stops 264, thereby inhibiting rotation of the locking mechanism 108 by forced engagement of the stops 264 with the recess 352. With brief forward reference to FIG. 18, rotation of the locking mechanism 108 is also further limited by a rotational stop slot 356 formed in the enclosure base 328 which is configured to engage and limit the rotational stop 170 on the lock cylinder 110. As there illustrated, the sides 358 and 360 of the rotational stop slot 356 are configured to abut the rotational stop 170 and define a first and second rotational limit of the locking mechanism 108.

Figure 18:
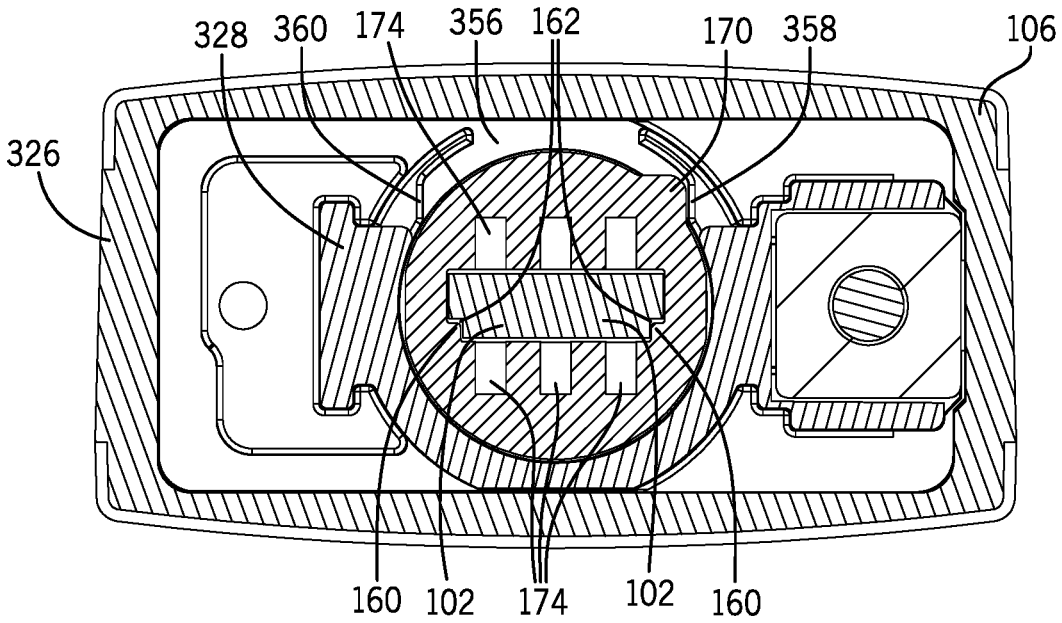
FIG. 18 is a top down cross-sectional view of the padlock and key taken through line 18-18 of FIG. 16.
Figure 19:
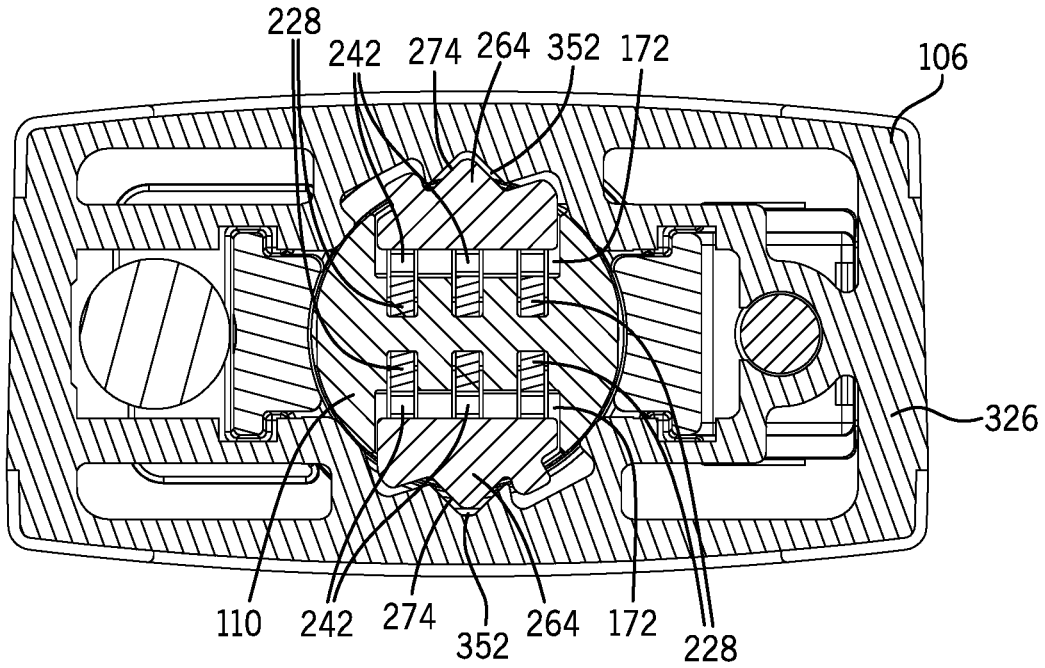
FIG. 19 is another top down cross-sectional view of the padlock and key taken through line 19-19 of FIG. 16.

Returning now to FIG. 12 and with additional reference being made to FIG. 19, when the tumblers 228 are aligned with the tumbler notches 242—which occurs when the appropriate key is inserted—each finger-receiving recess 352 is configured to direct the movable stop 264 into a respective one of the lateral slots 172 when the locking mechanism 108 begins to rotate. Essentially, as illustrated best in FIG. 19, the lateral slots 172 are enlarged by alignment with the notches 242, thereby permitting the radially inward movement of the stops 264. Still yet, recalling the rotational stop 170 and the stop slot 356 from FIG. 18, even with the ability for the movable stops 264 to be moved into the locking mechanism 108, the rotation of the locking mechanism 108 is still restricted by the rotational stop 170 and the stop slot 356 and its sides 358 and 360.

While the central chamber 332 is sized to inhibit significant radial motion of the locking mechanism 108 while still permitting it to rotate, the axial length of the central chamber 332 does not exactly closely correspond to that of the locking mechanism 108. In fact, the central chamber 332 is longer than the combined lengths of the locking mechanism 108, the cylinder cover 120, and the faceplate 286, thereby potentially permitting axial movement of the locking mechanism 108. This exists for a number of production reasons, but in part is because dimensions of the various components stacked up over the linear length might potentially differ.

In order to maintain a relatively known or static key stop distance from the key stop 176 on the lock cylinder to the key-receiving axial end 342 of the central chamber 332 (see e.g., both items on FIG. 11), a biasing element can be received in the central chamber 332 and can contact the locking mechanism 108 to bias the lock cylinder 110 along the axial direction toward the key receiving axial end 342 of the central chamber 332. In the illustrated embodiments, for example, a cam spring 116 is disposed in the cam spring opening 222 between the cam 112 and the interior axial end 346 to bias the locking mechanism 108, with the attached cylinder cover 120 and faceplate 286, towards the key-receiving axial end 342. Advantageously, this reduces the tolerance stack-up between the different subcomponents of the padlock 100 and the locking mechanism, allowing for a shorter padlock design and a wider variety of tumbler notch position options.

In linear locks, such as the illustrated padlock 100, the cam spring 116 is selected to provide a biasing force to maintain the key stop distance relative to the key entryway in the lock body 106, even as the key 102 is inserted into the lock cylinder 110. In such a case, the spring force provided by the cam spring 116 should exceed (in some design constructions, appreciably exceed) the collective spring force that will need to overcome the various tumbler springs 230 in order to move the tumblers 228 by the key. If this were not the case, then the attempted displacement of the tumblers 228 during insertion of the key 102 would also involve the movement of the locking mechanism 108 against the cam spring 116, which would alter the key stop distance undesirably.

It is to be appreciated that the cam spring can be selected based on different design criteria. The biasing force provided by a cam spring can be a function of at least one of spring length, spring material, or spring construction, spring type, or any other spring characteristic. Likewise, the cam spring will also likely be "preloaded" (i.e., initially in some compression) and appropriate spring modeling can be undertaken to achieve the desired applied force.

Still yet the "spring" may be differently placed in the assembly, be something other than a compression spring, and may be different in number. For example, in some embodiments, the cam spring can be configured to bias the locking mechanism 108 away from the keyway 114 and towards the interior axial end 346 thereby controllably and predictably forcing the locking mechanism against a different datum surface. In still other embodiments, instead of the compression spring, a different spring-like body providing a biasing force may be provided. For example, it is contemplated that the cylinder cover 120 could be formed from a compressible and springy material that is configured to bias the locking mechanism 108 towards the interior axial end 346 of the central chamber 332, which if appropriately dimensioned effectively replaces a compression spring with that elastically deformable polymeric body. In still further embodiments, other biasing element structural arrangements are possible. For example, some padlocks might utilize more than one biasing element, such as two, three, four or more cam springs instead of just one; however, having just one central spring does provide some benefit in that the rotation of the locking mechanism 108 then does not drag along the biasing structures. Still further, while the illustrated embodiment depicts a biasing element contacting an axial end of the locking mechanism, other biasing elements may make contact with the sides of a locking mechanism and/or be interposed between components of the locking mechanism.

Figure 13:
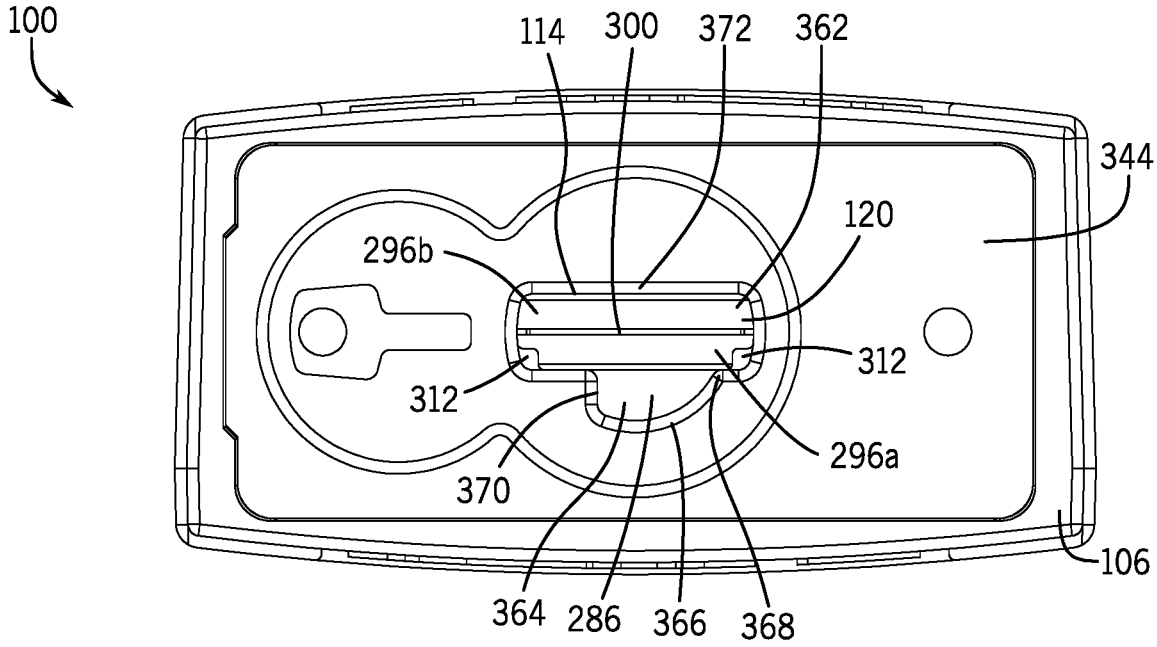
FIG. 13 is a bottom-up plan view of the padlock of FIG. 1.

Returning now to the structure of the lock body 106, the keyway 114 is formed through the enclosure base 328, thereby providing access to the central chamber 332 (and the locking mechanism 108 housed therein) through the key-receiving axial end 342. As illustrated in FIG. 13, the keyway 114 extends through the lock body 106 and has an eccentric profile defined by a keyway slot 362 configured to receive the key 102 and an asymmetric notch 364 or arc extending from one side of the keyway slot 362. The keyway slot 362 is centrally formed relative to the central chamber 332 and is dimensioned to receive the key shaft 392 of the key 102. When the locking mechanism 108 is received in the internal cavity 330, the keyway slot 362 is positioned to be in alignment with the keyhole 156 on the lock cylinder 110, thereby providing access to the locking mechanism 108 by the key 102. The asymmetric notch 364 of the keyway 114 defines a swept edge 366 extending in a continuous curve from a first end 368 on the edge of the keyway slot 362 to a key-stop edge 370. The curvature of the swept edge 366 is dimensioned such that, when the key 102 is turned, a notched section 394 of the key 102 extends between the swept edge 366 and a straight side 372 of the keyway slot 362 opposite the swept edge 366. As is described in greater detail with respect to FIGS. 14-15, the swept edge 366 and the straight side 372 of the keyway slot 362 can provide an axial stop configured to selectively retain the key 102 in the lock body 106, and the key-stop edge 370 can provide a rotational stop to the key 102 to restrict, at least in part, the amount of rotation of the lock cylinder 110.

In some embodiments, the keyway can have an eccentric profile shaped differently than in the illustrated embodiment. For example, the irregular notch can have at least one additional edge section that can be linear or curved. Some irregular notches can also use two or more linear edges with no curved section. A keyway can also include a key-stop edge that is formed at a different angle relative to the key slot.

Referring back to FIG. 10 showing the lock body 106, the two shackle slots 334, 336—a shallow shackle slot 334 and a deep shackle slot 336—are positioned on opposite sides of the central chamber 332 and are accessible through one of a corresponding pair of shackle openings 380 formed through the shackle-receiving side 382 of the lock body 106. Both shackle slots 334, 336 extend towards the key-receiving side 344 in a direction parallel to the central chamber 332, however, the deep shackle slot 336 extends further than the shallow shackle slot 334. The internal cavity 330 also includes adjoining passages 384 that link the central chamber 332 to both of the shackle slots 334, 336 in which the blocking elements (for example, the ball bearings 118) are receivable.

So, in addition to the locking mechanism 108, the internal cavity 330 is also configured to receive the shackle 104 in the shackle slots 334, 336. The short shaft 132 and the long shaft 134 of the shackle can be respective received in the shallow shackle slot 334 and the deep shackle slot 336 through the shackle openings 380. The shackle slots 334, 336 are configured to allow sliding motion of the shackle 104 between an closed position where the short shaft 132 and the long shaft 134 are received in the internal cavity 330 (see, for example, FIG. 20) and an open position in which only the long shaft 134 is received in the internal cavity 330 (see, for example, FIG. 24). In the closed position, the latching notches 138 on the shafts 132, 134 of the shackle 104 are configured to be aligned with and exposed to the adjoining passages 384. A ball bearing 118 is received in each of the adjoining passages 384 and can be permitted to move radially inward and outward therein based on the interaction with the bearing-engaging surfaces 208 of the cam 112. Because the ball bearings 118 have a diameter that is wider than the adjoining passages 384, the bearings 118 are only partially received by the adjoining passages 384 and selectively extend into at least one of the central chamber 332 or the respective one of the shackle slots 334, 336 based on the angular positioning of the cam 112.

Having described the structure and some general functions of a padlock, methods of using a key to lock and unlock the padlock will now be discussed. It should be appreciated that the methods and structures for locking and unlocking the padlock, or for performing any other task or function disclosed herein, are interchangeable and are not tied to the specific embodiment of the device in which they are described. Thus, this recitation, while exemplary, should not be taken as limiting.

While the locking mechanism 108 is in the locked position as illustrated in FIGS. 14 and 16 through 19, the bearing-engaging section 208 of the cam 112 is configured to block the ball bearings 118 from extending into the central chamber 332, thereby holding the ball bearings 118 radially outward. In this position, the ball bearings 118 are held in engagement with the latching notches 138 of the shackle 104, thereby inhibiting movement of the shackle 104.

To move the locking mechanism 108 to the unlocked position (shown in FIGS. 15 and 20 through 24, the padlock 100 is configured to be unlocked by the key 102, which can be inserted into the lock body 106 through the keyway 114, and received in the locking mechanism 108 through the plate keyhole 310 of the faceplate 286, the access slot 294 of the cylinder cover 120, and the keyhole 156 on the lock cylinder 110 (as is also depicted in FIGS. 14 and 16 through 19 with the key 102 being inserted, but not yet rotated). Upon insertion, the key 102 pushes the tumblers 228 in a direction parallel to the direction of key insertion, against a tumbler-biasing force, from the key-out position to the key-in position, thereby allowing the movable stops 264 to move radially inward into the lock cylinder 110 with the added clearance provided by the tumbler notches 242. The key 102 can then rotate the locking mechanism 108 from the locked position to the unlock position (illustrated in FIGS. 15 and 20 through 23) in which the ball bearings 118 can move into the cam recesses 218, 220, thereby disengaging the shackle 104 so that it can be moved into the open position of FIG. 24.

Figure 14:
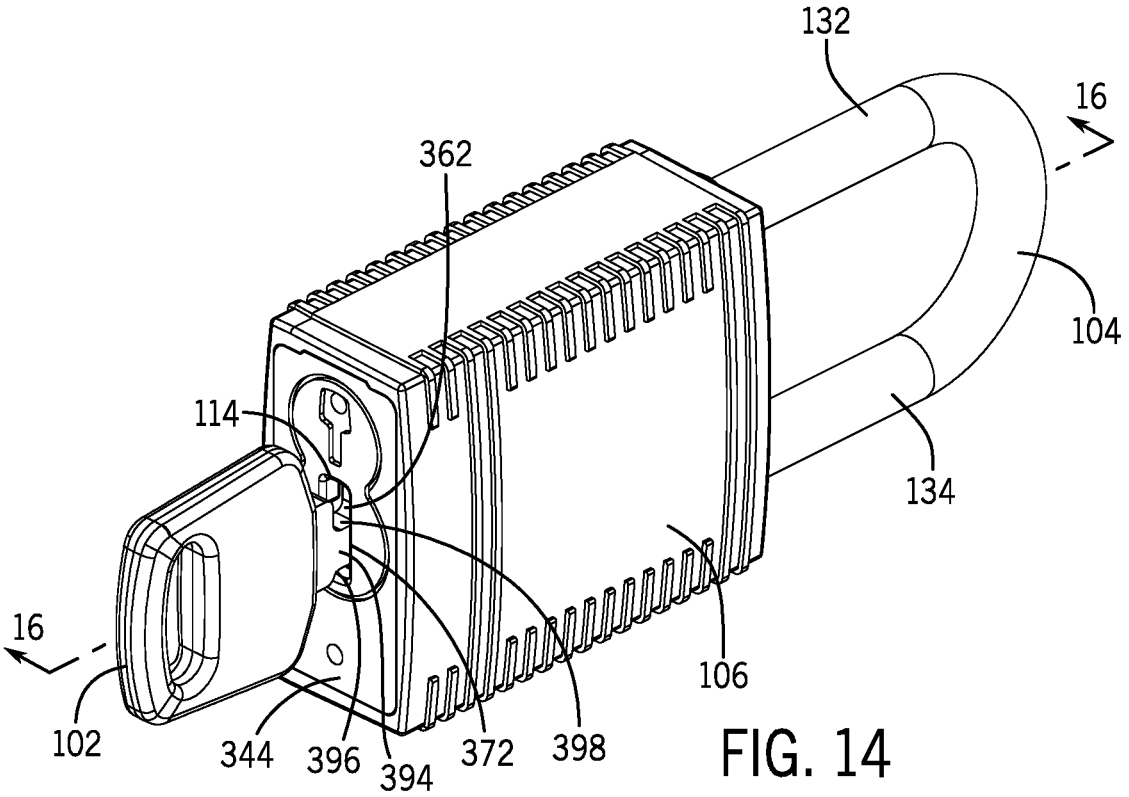
FIG. 14 is a perspective view of the padlock and the key of FIG. 1, in which the key is received in the lock body and the locking mechanism is in the locked position.
Figure 15:
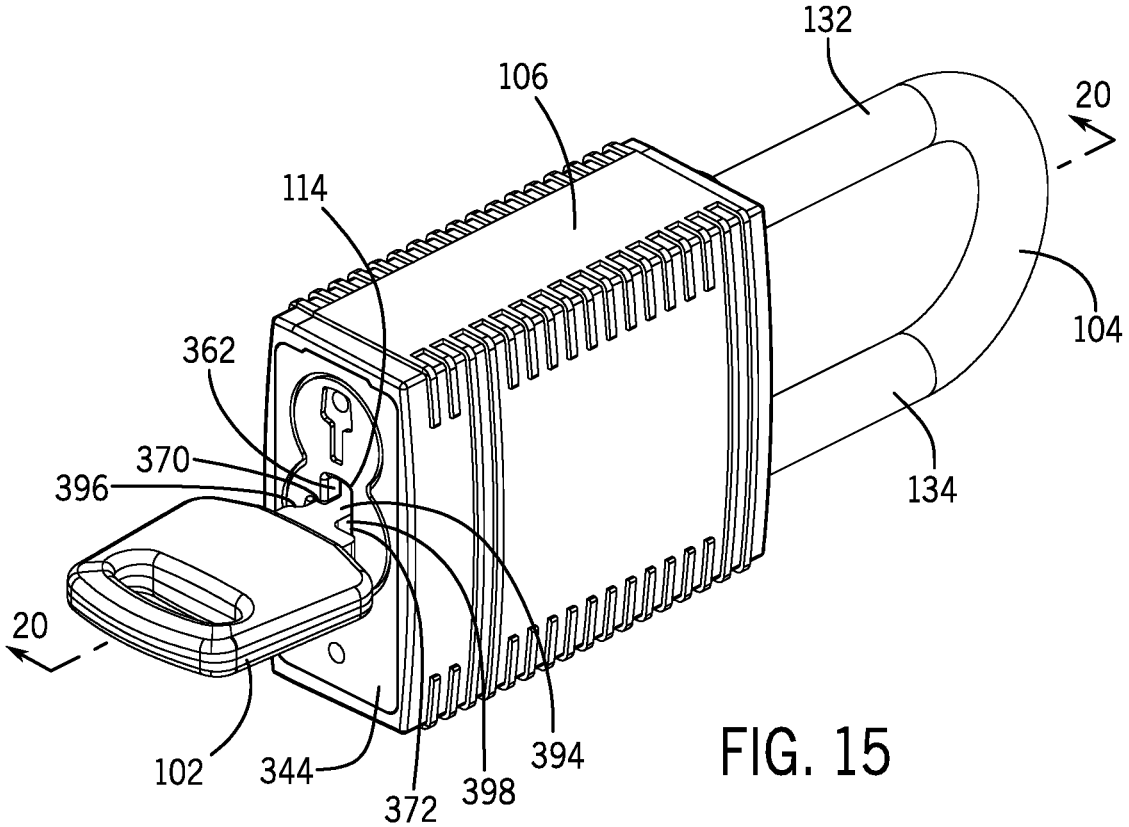
FIG. 15 is a perspective view of the padlock and the key of FIG. 14, where the key is rotated in the lock body and the locking mechanism is in the unlocked position.
Figure 16:
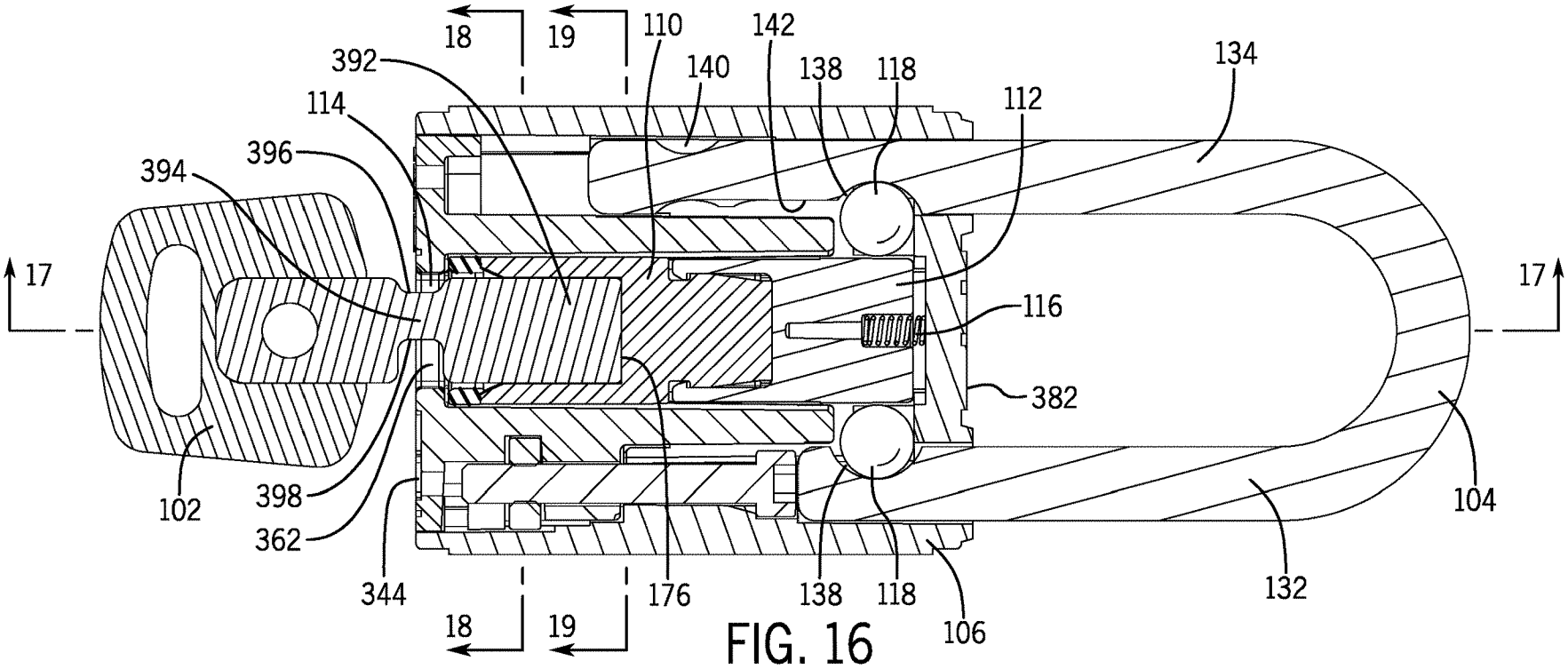
FIG. 16 is a front cross-sectional view of the padlock and key taken though line 16-16 of FIG. 14 in which the locking mechanism is in the locked position.

Exploring this key insertion and rotation process in more detail, FIGS. 14 and 16 through 19 depict the padlock 100 and key 102 before rotating the locking mechanism 108 and FIGS. 15 and 20 through 23 depict the padlock 100 and key 102 after rotating the locking mechanism 108. As illustrated in FIG. 14, the generally rectangular key shaft 392 (not shown in FIG. 14 because it is inserted, but see FIG. 1) of the key 102 can be inserted into the lock body 106 through the keyway slot 362 and into the locking mechanism 108. The indented corners 160 of the lock cylinder 110 and the indented corners 312 of the faceplate 286 are configured to block insertion of the key 102 in orientations where the recessed corners 162 of the key 102 are not in alignment with the indented corners 160 and 312. This ensures that the key 102 is oriented so that a shallow key notch 396 and a deep key notch 398, which are formed on opposite sides of the key shaft 392 (again, see FIG. 1), are also appropriately positioned proximate the first end 368 and the key-stop edge 370 in the keyway 114. In this orientation, the straight side 372 of the keyway slot 362 blocks rotation of the key 102 in one direction, providing a first rotational stop to the key 102 corresponding to the locked position of the locking mechanism 108. Still further, by limiting them manner of key insertion, it is possible to reduce the likelihood on an improper key being used to unlock the padlock (i.e., a key that is rotated 180 degrees), improving the overall security profile of the lock.

In the illustrated embodiment, when the locking mechanism 108 is in the locked position such that it may receive the key 102 by virtue of alignment with the keyway 114, the rotational stop 170 on the lock cylinder 110 abuts the first side 358 of the rotational stop slot 356 in the lock body 106 as illustrated in FIG. 18. The contact between the first side 358 and the rotational stop 170 prevents rotation of the locking mechanism 108 in the same direction as is prevented by contact between the key shaft 392 and the keyway 114, reinforcing the rotational limit corresponding to the locked position.

Before receiving the key 102 through its access slot 294, central opening 300 of the cylinder cover 120 is dimensioned to inhibit debris from moving into the locking mechanism. However, as best shown in FIG. 17, when and as the key 102 is inserted into the locking mechanism 108, the key shaft 392 flexes the wipers 296*a*, 296*b* of the cylinder cover 120 away from each other, widening the central opening 300 to accommodate passage of the key 102 therethrough. With continued insertion of the key 102, the tumblers 228 are each received by a tumbler recess 400 formed in the end of the key shaft 392 and the tumblers 228 are pushed away from the key-receiving axial end 342 until the key shaft 394 abuts the key stop 176 and the tumblers are in their respective key-in positions. Although, they are illustrated as uniform in the illustrated embodiment, each tumbler recess can be formed with a different depth or size that corresponds with a set of tumblers and key in a particular padlock to create a unique lock set. When a key is used with a padlock having a set of tumblers which do not correspond to the tumbler recesses in the key, the tumblers cannot simultaneously be moved to the proper key-in position needed to unlock that padlock and permit rotation of the locking mechanism 108 by rotation of the inserted key 102.

Returning to FIGS. 19 and 20, as the tumblers 228 move into the key-in position, the tumbler springs 230 become increasingly compressed, generating an increasing tumbler biasing force. This tumbler biasing force is transferred through the tumblers 228 and into the key 102 as an outward ejection force against the insertion of the key 102 into the locking mechanism. Once in the key-in position, the tumbler springs 230 are at a peak compression and, therefore, are applying a maximum tumbler biasing force on the tumblers 228 and a maximum outward ejection force on the key 102. As previously mentioned, the wipers 296*a*, 296*b* are configured to apply a griping force on the key 102 in a direction opposite the direction of key 102 movement. This gripping force can be leveraged to retain the key 102 in the lock cylinder 110 against the outward ejection force retaining the inserted key 102 in the padlock 100 even when the user releases the key 102 from his or her grip. Accordingly, in the illustrated embodiment, the wipers 296*a*, 296*b* have a thickness selected to generate a gripping force that is greater than the outward ejection force, allowing the wipers 296*a*, 296*b* to retain the key 102 in the lock body 106. Conveniently, this allows a key 102 to be stored in the padlock 100 while the locking mechanism 108 is still in the unlocked position.

In addition to applying an outward ejection force on the key, the tumbler springs 230 also apply an equal and opposite force on the cylinder-attachment end 212 of the cam 112. Absent the cam spring 116, this force would urge the locking mechanism 108 away from the key-receiving axial end 342 of the central chamber 332. However, the cam spring 116 of the illustrated embodiment is configured to have a biasing force which is greater than the outward ejection force from the tumbler springs 230 to axially urge and retain the locking mechanism 108 toward the key receiving axial end 342. This enables the cam spring 116 to maintain the key stop distance at least until the key 102 is fully inserted into the locking mechanism 108 and abuts the key stop 176.

As previously discussed with reference to FIG. 12, simultaneous engagement between the movable stops 264 and the respective one of the lateral slots 172 and the finger-receiving-recesses 352 prevents rotation of the locking mechanism when a proper key has not been inserted. However, as illustrated in FIGS. 17 and 19, once the tumblers 228 have been moved into the key-in position, the tumbler notches 242—which are aligned with the lateral slots 172—provide enough space for the movable stops 264 to move further into the locking mechanism 108 upon rotation of the locking mechanism 108. Therefore, when the key 102 is turned while in the lock body 106, the surface of the finger-receiving-recesses 352 push fingers of the movable stops 264 inward until the movable stops 264 are positioned within the cross sectional profile of the lock cylinder 110, allowing the locking mechanism 108 to rotate in the central chamber 332 and move out of the locked position as illustrated, for example, in FIG. 23.

As the key 102 rotates the locking mechanism 108 upon turning the key 102, the notched section 394 of the key shaft 392 rotates into the asymmetric notch 364 of the keyway 114. Rotation of the key 102 can continue until the locking mechanism 108 is in the unlocked position, as illustrated in FIGS. 15 and 20-23. Once in the unlocked position, further rotation of the key is inhibited by the key-stop edge 370 of the keyway 114, which abuts the notched section 394 of the key shaft 392 to provide a rotational stop corresponding to the unlocked position of the locking mechanism 108. Additionally, the rotational stop 170 on the lock cylinder 110 is configured to abut the second side 360 of the rotational stop slot 356 when the locking mechanism 108 reaches the locked position, providing another rotational stop corresponding to the unlocked position of the locking mechanism 108.

As the key 102 rotates, the swept edge 366 of the asymmetric notch 364 receives a shallow key notch 396 formed in the key shaft 392, and the straight side 372 of the keyway slot 362 receives a deep key notch 398 opposite the shallow key notch 396. While engaged by the key notches 396, 398, the eccentric profile of the keyway 114 provides an axial stop that permits the key 102 to be removed from the locking mechanism 108 only while the locking mechanism 108 is in the locked position with the notches otherwise straddling the material defining the keyway 114.

Figure 20:
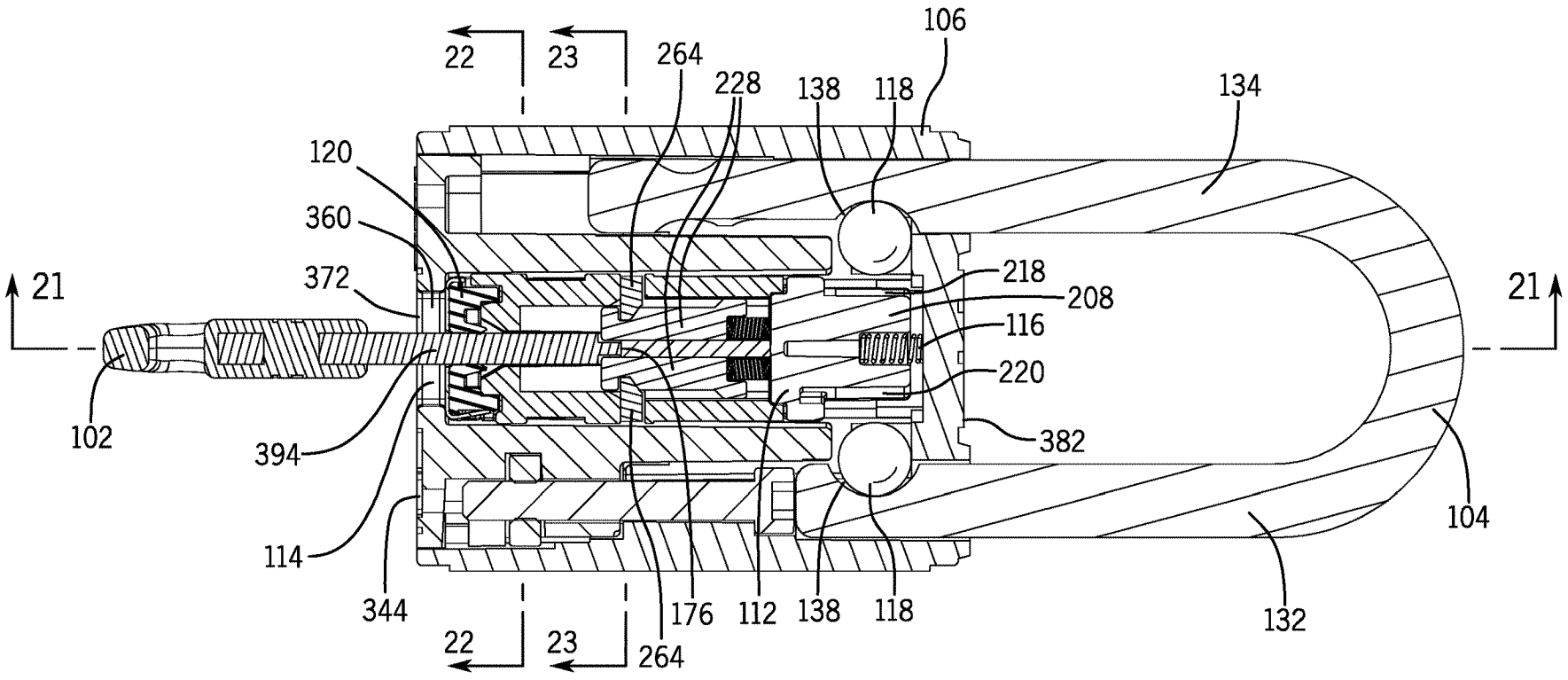
FIG. 20 is a front cross-sectional view of the padlock and key of FIG. 15 in which the locking mechanism is in the unlocked position.
Figure 21:
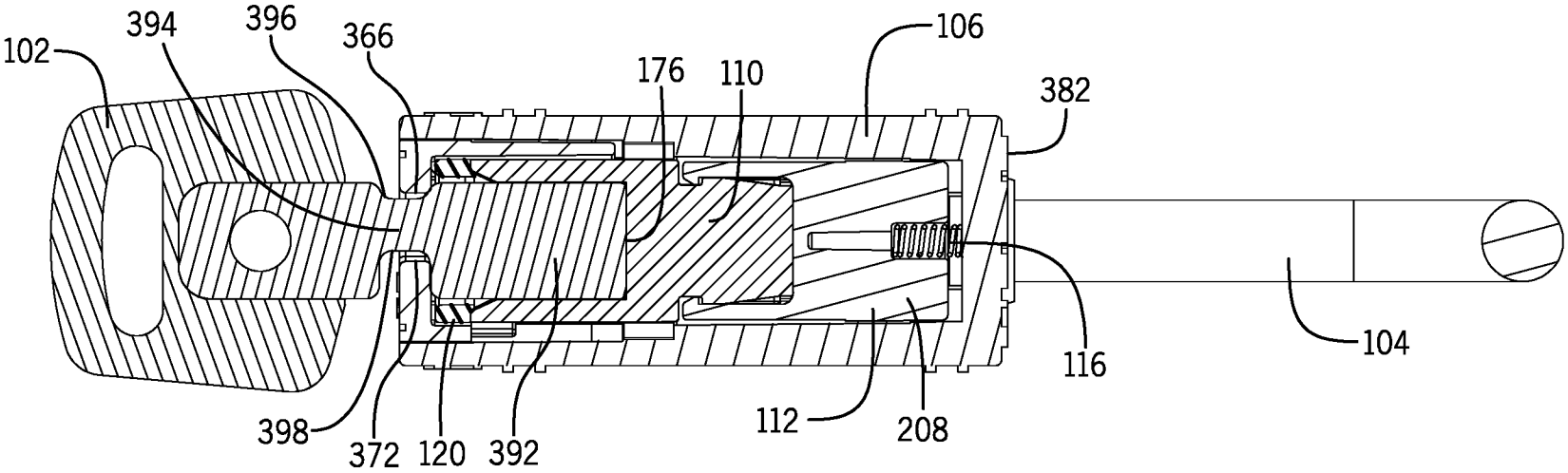
FIG. 21 is a side cross-sectional view of the padlock and key taken through line 21-21 of FIG. 20.
Figure 22:
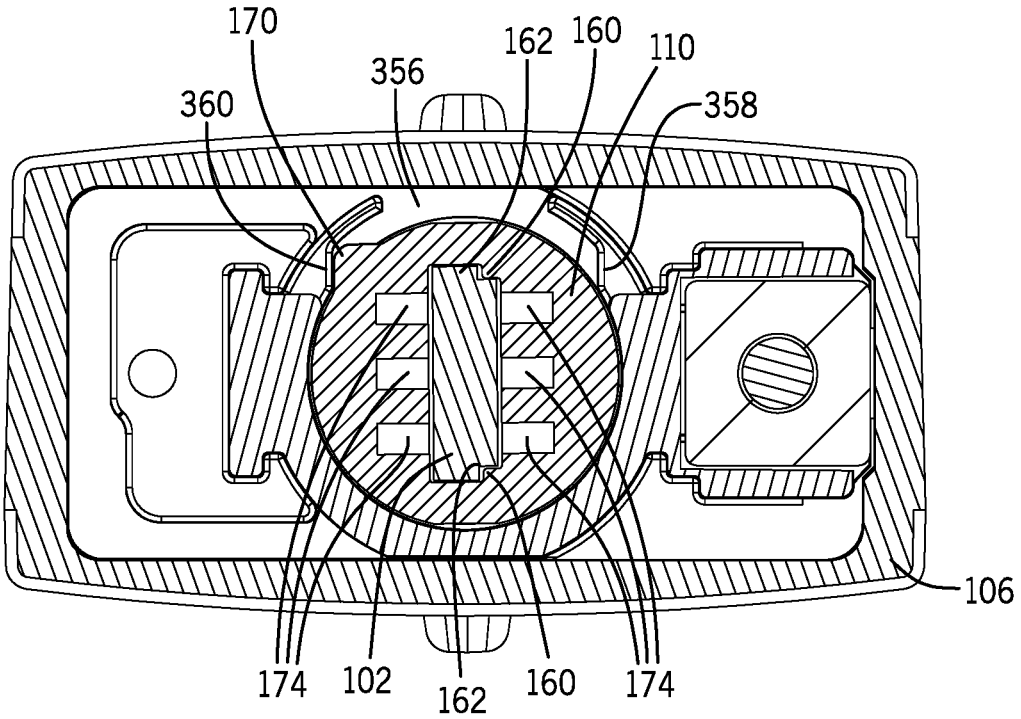
FIG. 22 is a top down cross-sectional view of the padlock and key taken through line 22-22 of FIG. 20.

Looking now to FIGS. 20 and 21, due to its integral connection with the lock cylinder 110, the cam 112 rotates ninety degrees with the lock cylinder 110 as the locking mechanism 108 moves to the unlocked position during key rotation from the locked to unlocked positions. In the unlocked position, the shallow cam recess 218 and the deep cam recess 220 are aligned with and face the short shaft 132 and the long shaft 134, respectively. The ball bearings 118 or blocking elements are then permitted to disengage the latching notches 138 and move radially inward and into the cam recesses 218, 220 (the clearances are shown in FIG. 20, albeit without the ball bearings 118 having been move inward yet). While the deep cam recess 220 provides enough space for the ball bearing 118 on the side of the short shaft 132 to move entirely out of the shallow shackle slot 334, the shallow cam recess 218 does not do the same. The shallow cam recess 218 only provides enough space for the ball bearing 118 to clear the recessed face 142 on the long shaft 134, but not enough to entirely move out of the deep shackle slot 336.

Figure 24:
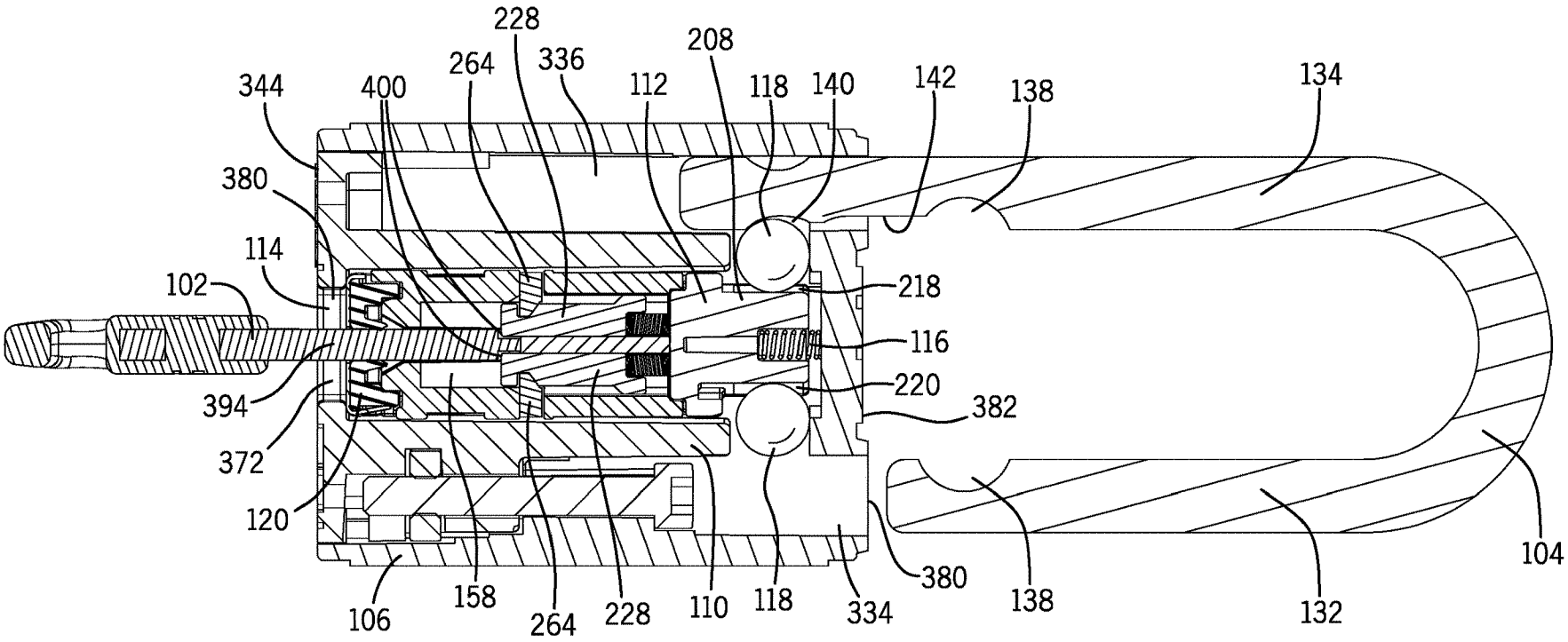
FIG. 24 is a front cross-sectional view of the padlock and key of FIG. 15 with the shackle in the open position as opposed to the closed position of FIG. 15.

Once the bearings can move inward, the shackle 104 can be moved from the closed position into the open position by sliding away from the shackle-receiving side 382 of the lock body until the ball bearing 118 on the side of the long shaft 134 abuts the lower edge of the retention grove 140. As shown in FIG. 24, the short shaft 132 of the shackle 104 is fully disengaged from the lock body 106 in the open position. Conversely, the long shaft 134 is retained in the deep shackle slot 336 due to its partial engagement with the retention grove 140 (and the shackle 104 can only be withdrawn partially and remains with the lock body 106 even when unlocked). Because the retention grove 140 is formed around the circumference of the long shaft 134, the shackle can and rotate about the long shaft 134 so that the padlock 100 can be secured to one or more objects.

To re-lock the padlock 100, the shackle 104 is moved back to the closed position with the short shaft 132 in the shallow shackle slot 334 and the key 102 is turned to move the locking mechanism 108 back to the locked position. As the cam 112 rotates it pushes the ball bearings 118 back into engagement with the latching notches 138 on the shackle 104, restricting axial motion of the shackle 104. As the key 102 is extracted from the locking mechanism 108, the tumbler springs 230 bias the tumblers 228 back into their key-out positions. As the tumblers 228 move the inclined end 244 of the tumbler notches 242 push against the angle surface 272 of the movable stops 264 thereby pushing the movable stops 264 radially outward and into engagement with the finger-receiving recesses 352, thereby securing the locking mechanism 108 in the locked position once again.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

What is claimed is:

1. A padlock configured to be locked and unlocked by a key, the padlock comprising:

a lock body having an internal cavity with a locking mechanism received therein, the locking mechanism being a linear lock configured to receive the key through a keyhole to lock and unlock the padlock, where a direction of insertion of the key into the locking mechanism is parallel with a direction of displacement of a plurality of tumblers in the locking mechanism thereby creating an outward ejection force on a fully-inserted key; and a cover disposed on the locking mechanism proximate the keyhole, the cover being configured to retain the key in position relative to the locking mechanism against the outward ejection force after the key is received in therein wherein the cover includes at least one tab configured to be received by the locking mechanism such that the cover travels rotationally with the locking mechanism.

2. The padlock of claim 1, wherein the cover includes an access slot formed around the keyhole and at least one flexible wiper that extends from a side of the access slot, the at least one flexible wiper being configured to grip the key after the key is inserted into the locking mechanism.

3. The padlock of claim 2, wherein the at least one flexible wiper has a thickness selected to retain the key in the locking mechanism against the outward ejection force on the fully-inserted key.

4. The padlock of claim 2, wherein the thickness of the at least of flexible wiper decreases along the length of the at least of flexible wiper.

5. The padlock of claim 2, wherein the at least one flexible wiper is tapered radially inward in the axial direction toward the locking mechanism.

6. The padlock of claim 2, wherein the at least one flexible wiper includes a first wiper extending from a first side of the access slot and a second wiper extending from a second side of the access slot opposite the first side.

7. The padlock of claim 6, wherein the first wiper and the second wiper define a thin central opening through the access slot before the key is received in the locking mechanism.

8. The padlock of claim 6, wherein the first wiper is configured to be pushed outward toward the first side of the access slot and the second wiper is configured to be pushed toward the second side of the access slot when the key is inserted into the locking mechanism.

9. The padlock of claim 8, wherein the first wiper and the second wiper are biased towards the key to retain the key in the locking mechanism against the outward ejection force.

10. The padlock of claim 2, wherein the at least one flexible wiper applies a gripping force against the outward ejection force onto the key.

11. The padlock of claim 10, wherein the gripping force is a friction force between the at least one flexible wiper and the key.

12. The padlock of claim 2, wherein the at least one flexible wiper is configured to be flexed in a radially-outward direction when the key is inserted into the locking mechanism.

13. The padlock of claim 2, further comprising a faceplate configured to restrict axial deflection of the at least one flexible wiper away from the locking mechanism.

14. The padlock of claim 1, further comprising a faceplate disposed on an axial end of the cover opposite the locking mechanism.

15. The padlock of claim 14, wherein the face plate wraps around a portion of the cover.

16. The padlock of claim 14, wherein the face plate retains the cover on the locking mechanism.

17. The padlock of claim 1, wherein the cover comprises a polymer material.

18. The padlock of claim 1, wherein the cover is configured to cover a portion of the keyhole before the key is inserted into the locking mechanism.

19. The padlock of claim 18, wherein the cover selectively inhibit entry of debris into the locking mechanism.

* * * * *